US006135448A

United States Patent [19]

Daito

[11] Patent Number: 6,135,448

[45] Date of Patent: Oct. 24, 2000

[54] SHEET CONVEYING APPARATUS

[75] Inventor: Hiroshi Daito, Kanagawa, Japan

[73] Assignee: Fuji Photo Film Co., Ltd., Kanagawa, Japan

[21] Appl. No.: 09/328,594

[22] Filed: Jun. 10, 1999

[30] Foreign Application Priority Data

Jun. 11, 1998 [JP] Japan ..... 10-163317

[51] Int. Cl.[7] ..... B65H 5/34; B65H 29/66; B65H 39/10; B65H 47/26

[52] U.S. Cl. ..... 271/270; 271/272; 271/300; 271/202; 198/433

[58] Field of Search ..... 271/270 O, 272 C, 271/300 C, 202 C; 198/57.03, 433 C, 461.1

[56] References Cited

U.S. PATENT DOCUMENTS

| | | | |
|---|---|---|---|
| 3,506,110 | 4/1970 | Paul et al. | 198/75 X |
| 4,314,644 | 2/1982 | Stocker | 209/569 X |
| 4,597,490 | 7/1986 | Selignan | 198/468.5 X |
| 4,705,159 | 11/1987 | Feliks et al. | 198/468.8 X |
| 4,931,826 | 6/1990 | Lucht et al. | 355/28 X |
| 5,374,052 | 12/1994 | Folsom | 271/255 X |
| 5,653,328 | 8/1997 | Pedrotto | 198/418.1 X |
| 5,675,836 | 10/1997 | Matsumoto | 396/594 |
| 5,678,111 | 10/1997 | Matsumoto | 396/564 X |

FOREIGN PATENT DOCUMENTS

| | | | |
|---|---|---|---|
| 60-23343 | 6/1985 | Japan | G03D 13/00 |

*Primary Examiner*—Christopher P. Ellis
*Assistant Examiner*—Kenneth W Bower
*Attorney, Agent, or Firm*—Sughrue, Mion, Zinn, Macpeak & Seas, PLLC

[57] ABSTRACT

A plurality of sheets are fed along a plurality of rows of conveying paths in a state in which leading edges of the respective sheets in the conveying direction are spaced apart from each other in a longitudinal direction, and fed from an outlet of the conveying paths by a high-speed feeding means at a speed which is greater than or equal to a conveying speed of the conveying path. In the feeding section, the plurality of sheets are received by a moving endless belt, arranged, and then fed out. As a result, the present invention can provide a sheet conveying apparatus which has a simple structure and a simple control system and in which a plurality of the sheets which are conveyed along the plurality of rows of the conveying paths are fed while being arranged in a single row in the feeding section.

19 Claims, 21 Drawing Sheets

SHEET CONVEYING APPARATUS

BACKGROUND OF THE INVENTION

1. Field of the Invention

The present invention relates to a sheet conveying apparatus that enables a plurality of sheets such as printing paper, films, or the like, which have been conveyed along a plurality of rows of conveying paths, respectively to be fed while being arranged in a single row.

2. Description of the Related Art

A printer processor of a machine using a sheet conveying apparatus may be given as an example. In such a printer processor, a photosensitive material that is rolled in a roll state is fed continuously and sent to an exposure section where a printing process is performed on the photosensitive material. The printing paper in the roll state is then cut each time a frame image on a photographic film is exposed in the exposure section.

Since the printing process time taken in this exposure section is extremely short as compared to the developing process time in a developing section that follows on this, each piece of the exposed printing paper which has been cut into a plurality of pieces is distributed onto a plurality of rows of conveying paths and then fed to the developing section while being arranged so as to form a staggered arrangement over all conveying paths.

In the developing section, a developing process is performed on a plurality of pieces of the printing paper which are fed along the plurality of rows of the conveying paths while being arranged in parallel. In this way, since the plurality of the pieces of printing paper are subject to the developing process while being arranged in parallel, waiting time becomes unnecessary for the printing paper having completed the exposure process in the exposure section, and the exposed printing paper is thereby directly fed to the developing section. Accordingly, the processes of the printing paper as a whole can be performed in accordance with a short processing time in the exposure section. As a result, the processing time as a whole can be reduced as compared to the case in which a developing process is performed on a piece of the exposed printing paper in a roll state while being arranged in a single row as it is without being cut off, namely, the case in which the processes of the printing paper as a whole are performed in accordance with a long processing time in the developing section.

In this way, the plurality of pieces of the printing paper, which are fed along the plurality of the conveying paths in the developing section, are conveyed by the sheet conveying apparatus so as to form a line, in sequence they are exposed in the exposure section.

Conventionally, as an example of such a sheet conveying apparatus as described above, Japanese Patent Application Publication (JP-B) No. 60-23343 discloses a printing paper pick-up device of a developing machine.

In this disclosure, a developing process is performed on the exposed printing paper as they pass through a developing processing tank while being conveyed along a plurality of the conveying paths arranged in parallel, and gate means are provided at the respective conveying paths at an outlet side of this developing processing tank so as to prevent the conveyance of each of the printing paper. When the printing paper that have been conveyed along each of the conveying paths which are disposed in parallel, are arranged in a transverse line by these gate means, or when a predetermined time has passed since the first printing paper reached the gate means, the gate means are opened in sequence at predetermined intervals so as to control the pieces of printing paper, which have been prevented from being conveyed by each of the gate means, to be fed sequentially in that order they are exposed.

In such a printing paper pick-up device of a developing machine as described above as one of the conventional sheet conveying apparatuses, because gate means should be provided so as to halt the printing paper on the plurality of the conveying paths, and a sensor for detecting whether the printing paper are halted at each of the gate means should also be provided, a structure for forming the device becomes complicated. Further, there has been a problem in that a structure for carrying out an operation, in which each of the printing paper which have been halted at the respective gate means is released under a predetermined condition, and then fed intermittently, becomes complicated.

SUMMARY OF THE INVENTION

In view of the aforementioned facts, it is an object of the present invention to newly provide a sheet conveying apparatus which is simply structured and whose control contents can be simplified, and which enables a plurality of sheets which are conveyed along a plurality of rows of conveying paths to be fed while being arranged in a single row in accordance with a predetermined sequence.

The first aspect of the present invention is a sheet conveying apparatus, comprising: a conveying path section that feeds a plurality of sheets along a plurality of conveying paths set in a plurality of rows in a state in which the leading edges of the respective sheets in the conveying direction are spaced apart from each other in a longitudinal direction; high-speed feeding means that is disposed at an outlet portion of the conveying path section, and feeds each of the sheets which have been conveyed along the conveying path at a speed which is higher than or equal to the conveying speed of the conveying path; and a feeding section in which the sheets which have been fed from the high-speed feeding means are arranged by being received by a moving endless belt, and fed out.

By structuring the present aspect as described above, it is possible to provide a sheet conveying apparatus with a simple structure in which a plurality of the sheets, which have been conveyed across a plurality of rows along the conveying path section, are fed by being arranged in a single row in accordance with a predetermined sequence in the feeding section. Further, since the feeding section is capable of performing an operation of feeding the sheets in a state in which the endless belt is moving all the time, a control system for performing an intermittent movement of the endless belt becomes unnecessary, thus making the structure more simple.

The second aspect of the present invention is a sheet conveying apparatus, comprising: a conveying path section having a normal conveying path for conveying the sheet from an inlet to an outlet along a plurality of conveying paths set in a plurality rows in a state where the leading edges of the respective sheets in the direction in which the sheets are conveyed are spaced apart from each other in a longitudinal direction, a distinct conveying path for conveying the sheet from the inlet to another outlet, and a conveying path switching section for switching the path along which the sheet is conveyed from between either the normal conveying path and the distinct conveying path; high-speed feeding means disposed at the outlet portion of the normal conveying path of the conveying path section which feeds each of the sheets which have been conveyed along the normal conveying path at a speed which is greater than or equal to the conveying speed of the normal conveying path; and a feeding section in which the sheets which have been fed from the high-speed feeding means are arranged by being received by a moving endless belt and fed out.

By structuring this second aspect as described above, it is possible to provide a sheet conveying apparatus with a simple structure in which a plurality of the sheets, which have been conveyed across a plurality of rows along the conveying path section, are fed by being arranged in a single row in accordance with a predetermined sequence in the feeding section. Further, since the feeding section is capable of performing an operation of feeding the sheets in a state in which the endless belt is moving all the time, a control system for performing an intermittent movement of the endless belt becomes unnecessary, thus making the structure more simple.

By performing a switching operation of the conveying path switching section due to conditions such as size and the like of sheets, the sheets can be assorted while being conveyed into the normal conveying path side or the distinct conveying path side.

The third aspect of the present invention is a sheet conveying apparatus, comprising: a conveying path section having a normal conveying path for conveying the sheet from an inlet to an outlet along a plurality of conveying paths set in a plurality rows in a state where the leading edges of the respective sheets in the direction in which the sheets are conveyed are spaced apart from each other in a longitudinal direction, a distinct conveying path for conveying the sheet from the inlet to another outlet, and a conveying path switching section for switching the path along which the sheet is conveyed from between either the normal conveying path and the distinct conveying path; high-speed feeding means disposed at the outlet portion of the normal conveying path of the conveying path section which feeds each of the sheets which have been conveyed along the normal conveying path at a speed which is greater than or equal to the conveying speed of the normal conveying path; and a feeding section in which the sheets which have been fed from the high-speed feeding means are arranged by being received by a moving endless belt and fed out.

By structuring this third aspect of the present invention as described above, in addition to the effects of the present invention according to the second aspect, even when the solenoid apparatus is exposed to high temperature, it becomes unnecessary to use the solenoid apparatus with a large load capacity by considering that an attraction force deteriorates so that the load capacity of the solenoid apparatus can be reduced.

The fourth aspect of the present invention is a sheet conveying apparatus according to the first aspect, wherein when the length in the conveying direction of each of the sheets that are conveyed along the conveying path is greater than or equal to a predetermined length, the speed at which the sheets are fed by the high-speed feeding means is reduced to approximately the same speed as the conveying path.

By structuring the fourth aspect as described above, a load applied to the high-speed feeding means is reduced, and the life cycle thereof can be prolonged and the loading capacity thereof can be reduced.

The fifth aspect of the present invention is a sheet conveying apparatus according to the first aspect, wherein a portion of the conveying path section is independently removable to the outside of the apparatus using a slide support mechanism so as to be disposed parallel to the slide support mechanism, wherein the sheet conveying apparatus is provided with an auxiliary supporting structure which receives the independently removable portion of the conveying path section in an auxiliary manner when the slide support mechanism is being removed from or replaced in the apparatus.

By structuring the fifth aspect of the present invention as described above, since a jammed sheet can be taken out by the conveying path section is provided outside the sheet conveying apparatus, the maintenance can be facilitated. Further, when the slide support mechanism is detached, the conveying path section can be received by the auxiliary supporting structure. Further, operation can be carried out in a state in which the conveying path section is supported by the auxiliary supporting structure during connection and assembly operation of the slide support mechanism.

The sixth aspect of the present invention is a sheet conveying apparatus according to the second aspect or the third aspect, wherein the side plate portion of the removable portion of the conveying section nearest the front in the direction in which the conveying section is removed and the handle provided on the side plate portion are formed by a resin material whose coefficient of thermal expansion is near that of the metal frame of the conveying path section.

By structuring the sixth aspect of the present invention as described above, when the conveying path section is at high temperature during the use, since the handle portion thereof is made from a resin, the operator can grab the handle portion thereof and perform a pull-out operation of the conveying path section. Further, even when the frame structure of the conveying path section is formed by the combination of the resin made side plate portion and the metal frame, a difference that is caused by a difference between thermal expansion coefficients of the resin made side plate portion and the metal frame is prevented from causing between members for forming the conveying path section. As a result, sheets can be conveyed appropriately along the conveying path.

DESCRIPTION OF THE PREFERRED EMBODIMENT

Figure 1:
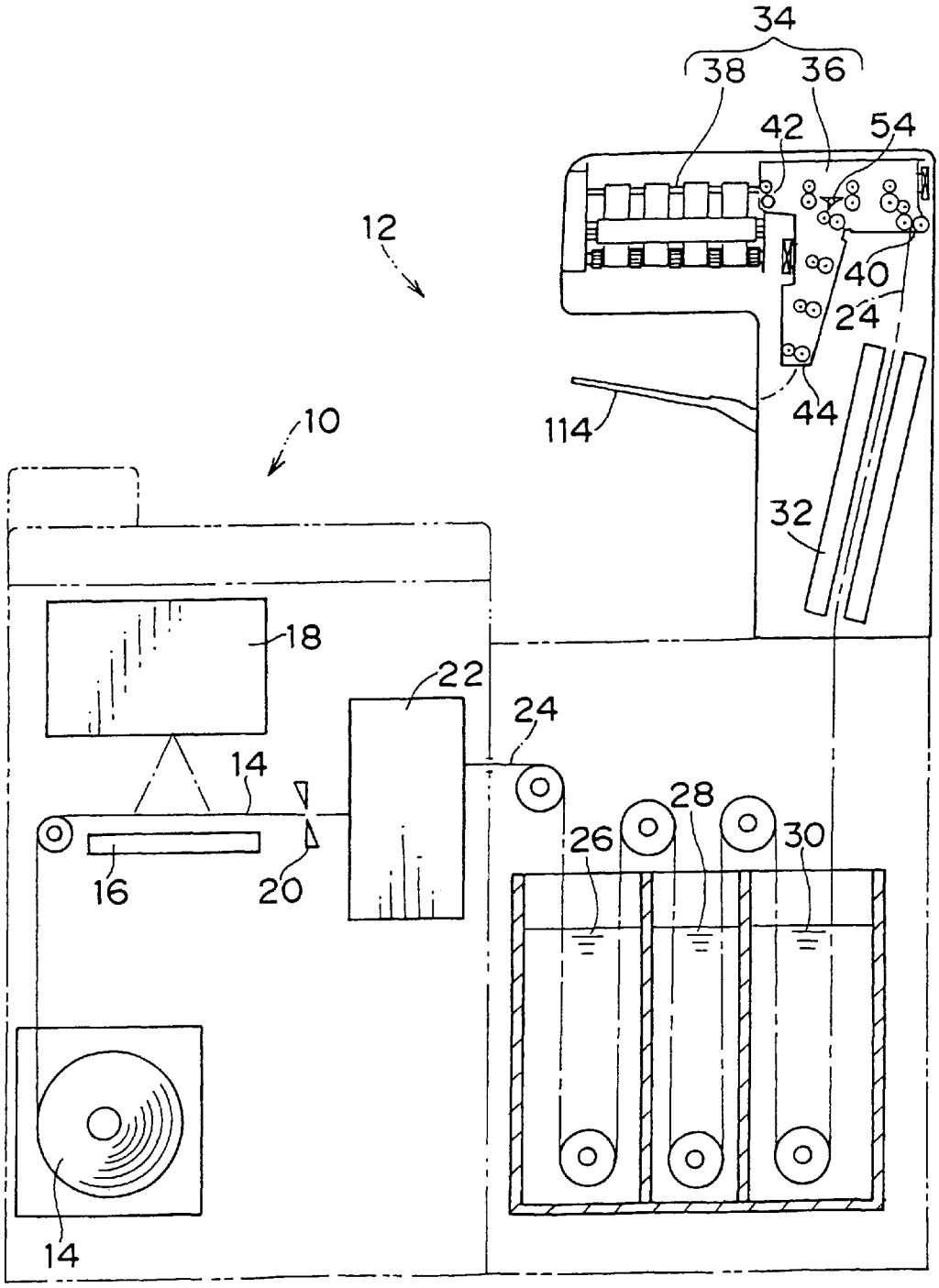
FIG. 1 is an overall schematic structural view that illustrates a printer processor having a sheet conveying apparatus according to the present invention.
Figure 2:
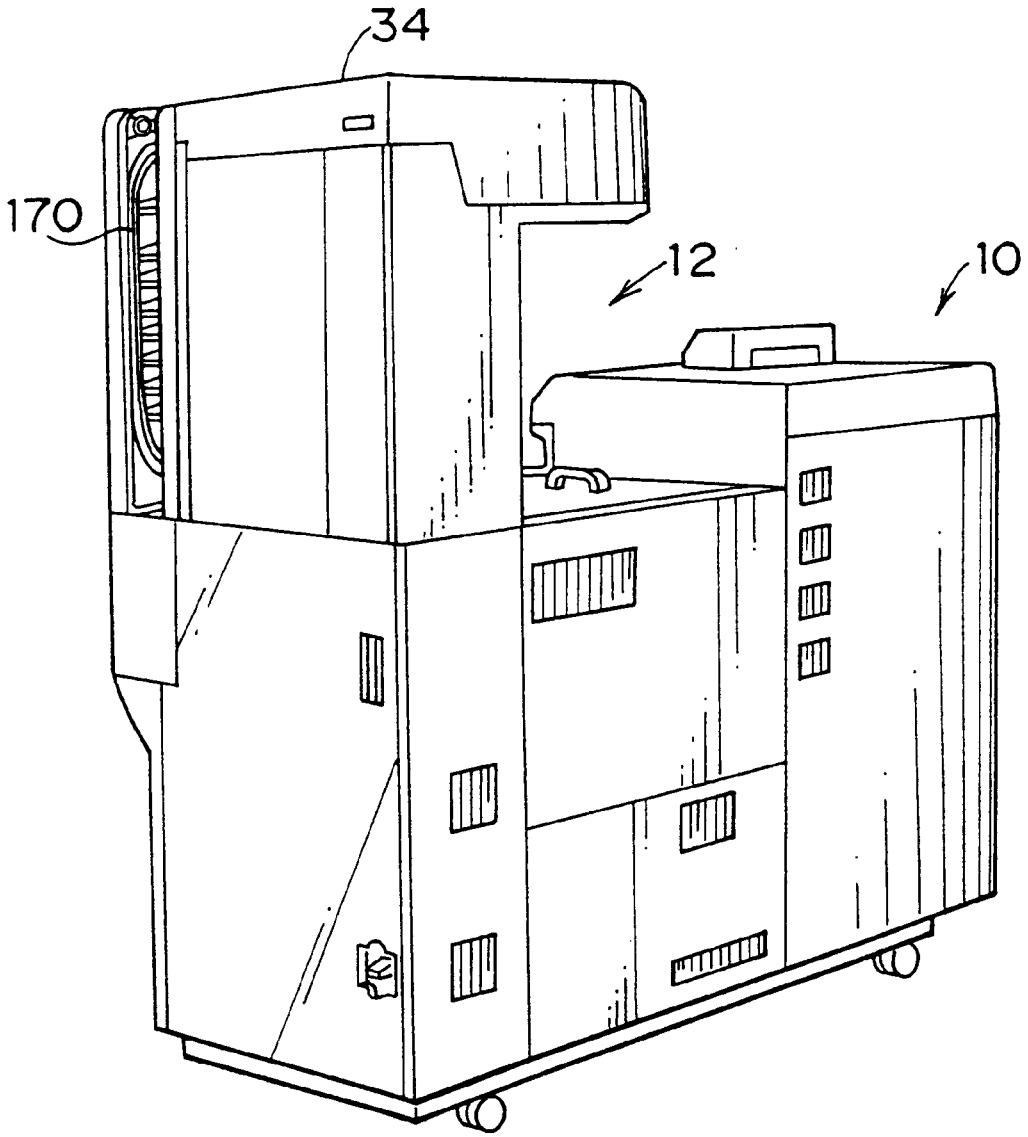
FIG. 2 is an overall perspective view that illustrates a back face side of the printer processor having the sheet conveying apparatus according to the present invention.
Figure 3:
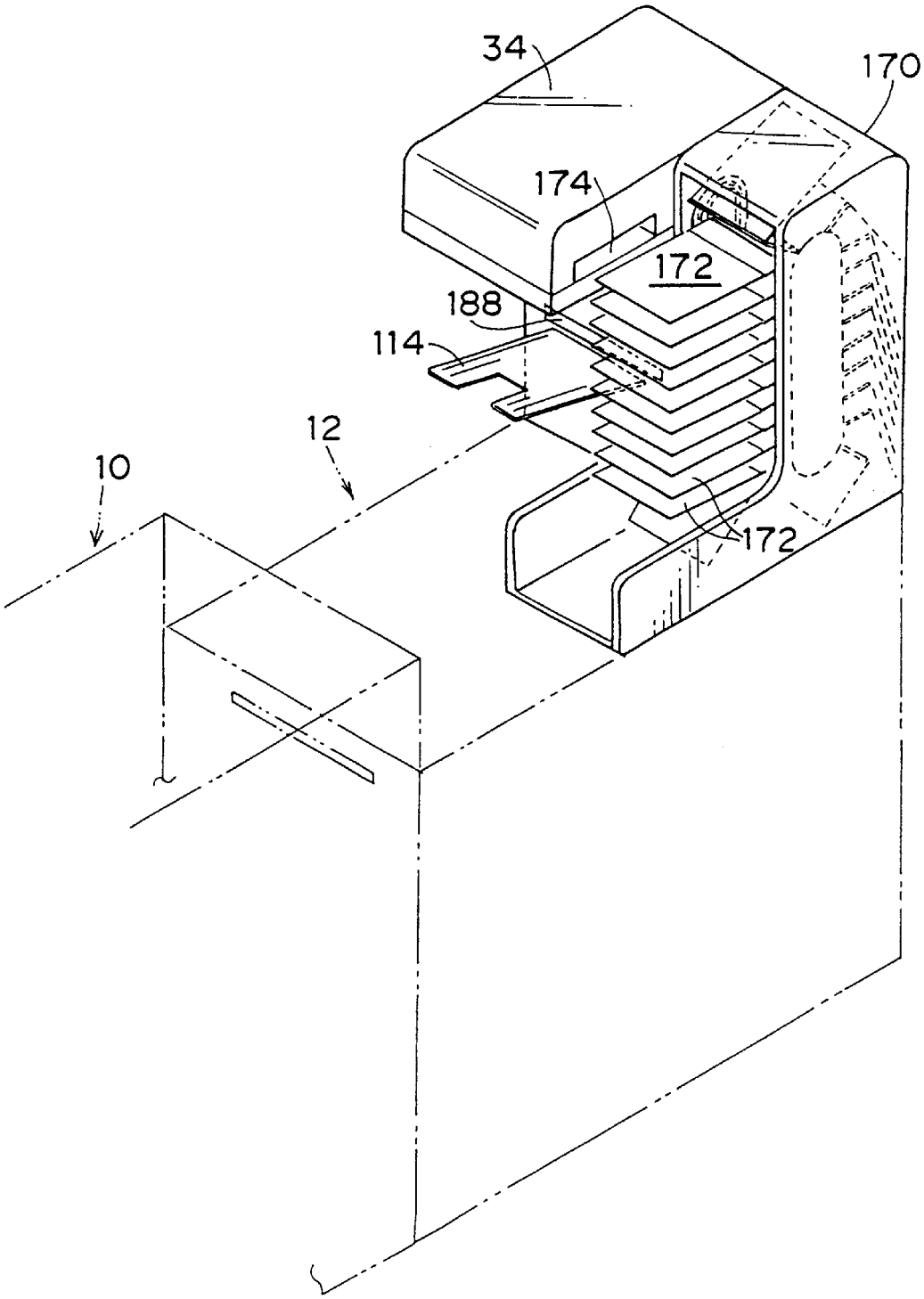
FIG. 3 is a main portion schematic perspective view that illustrates a sheet conveying section and a sheet sorter section in the printer processor having the sheet conveying apparatus according to the present invention.

An overall schematic structure of a printer processor provided with a sheet conveying apparatus of the present invention is shown in FIGS. 1 to 3. This printer processor mainly comprises a printer section 10 and a processor section 12.

A printing paper 14 which is rolled in a roll state is stored in the printer section 10 as is shown in FIG. 1, and the leading edge portion of the printing paper 14 which is pulled out from this roll is fed toward an exposure section 16 along a predetermined conveying path. This exposure section 16 is structured such that an exposure process of an image is performed on the exposure surface of the printing paper 14, using an exposure apparatus 18 such as a laser scanning exposure system. The strip-shaped printing paper 14, having completed the exposure process thereof in the exposure section 16, is cut into a predetermined size by a cutter 20 so as to correspond to the size of the exposed image (so-called L size, panoramic size, wide 8×10 inch size, or A4 size).

A plurality of the printing paper 14, which are formed into various sizes of sheet pieces by being cut as described above, are led to a dispensing apparatus 22, and dispensed into a plurality of rows of a conveying path 24 which is disposed over a developing processing process in the processor section 12 such that a plurality of the printing paper 14 form a so-called staggered arrangement, and then fed along the conveying path 24. In the processor section 12 of the present embodiment, the conveying path 24 is set in three rows parallel to one another (the conveying path 24 can also be set in any number of rows when the number of rows is two or more). Thus, in the case in which the conveying path 24 is set in three rows, a conveying speed when the task of the exposure process is performed in the printer section 10 and a conveying speed when the task of the developing process is performed in the processor section 12 substantially correspond to each other. Accordingly, waiting time during which a processing task is transferred from the exposure process to the developing process is made lost, or there is no spare time which is caused by the developing process being performed earlier than the exposure process. As a result, the processing task as a whole is performed continuously, smoothly and usefully.

In this dispensing apparatus 22, a first printing paper 14 which is fed firstly is placed on a first conveying path 24, among three rows of the conveying paths 24. Next, a second printing paper 14 which is fed secondly is placed on a second conveying path 24 at a position where the leading edge portion of the second printing paper 14 at the downstream side of the second conveying path 24 is conveyed slightly later to the very least, than the downstream side leading edge portion of the first printing paper 14 (position where the second printing paper 14 is displaced toward the upstream of the conveying paths 24 as a whole). Next, a third printing paper 14 which is fed thirdly is placed on a third conveying path 24 at a position where the leading edge portion of the third printing paper 14 at the downstream side of the third conveying path 24 is conveyed later than the downstream side leading edge portion of the second printing paper 14. Next, a fourth printing paper 14 which is fed fourthly is placed on the first conveying path 24 at a position where the leading edge portion of the fourth printing paper 14 at the downstream side of the first conveying path 24 is conveyed later than the downstream side leading edge portion of the third printing paper 14.

This dispensing apparatus 22 is structured as below described. Since a plurality of sheets are fed along the conveying paths set in a plurality of rows in a state in which the conveying direction leading edges of the respective sheets are displaced so as to be spaced apart from one another, the dispensing apparatus 22 dispenses each of the printing paper 14 to each of the plurality of rows of the conveying paths 24 in sequence, and all of the plurality of the rows of the conveying paths 24 are dispensed so as to form a staggered arrangement in which the leading edges of the pieces of printing paper 14 at the downstream side in the conveying direction are displaced from each other toward the upstream side in the conveying direction in sequence each of the printing paper 14 is placed on the conveying paths 24.

The printing paper 14, which have been formed in a staggered arrangement into a plurality of rows of the conveying paths 24, are fed along the conveying paths 24, and immersed in a developing solution tank 26, a bleaching/fixing solution tank 28, and a washing solution tank 30 in sequence, thus performing a developing process thereof.

The printing paper 14, for which the developing process has been completed, are fed inside a drying section 32 provided further downstream the plurality of rows of the conveying paths 24 so that a drying process thereof is performed. Thereafter, the pieces of printing paper 14 are fed to a conveying section 34 serving as a sheet conveying apparatus.

Figure 4:
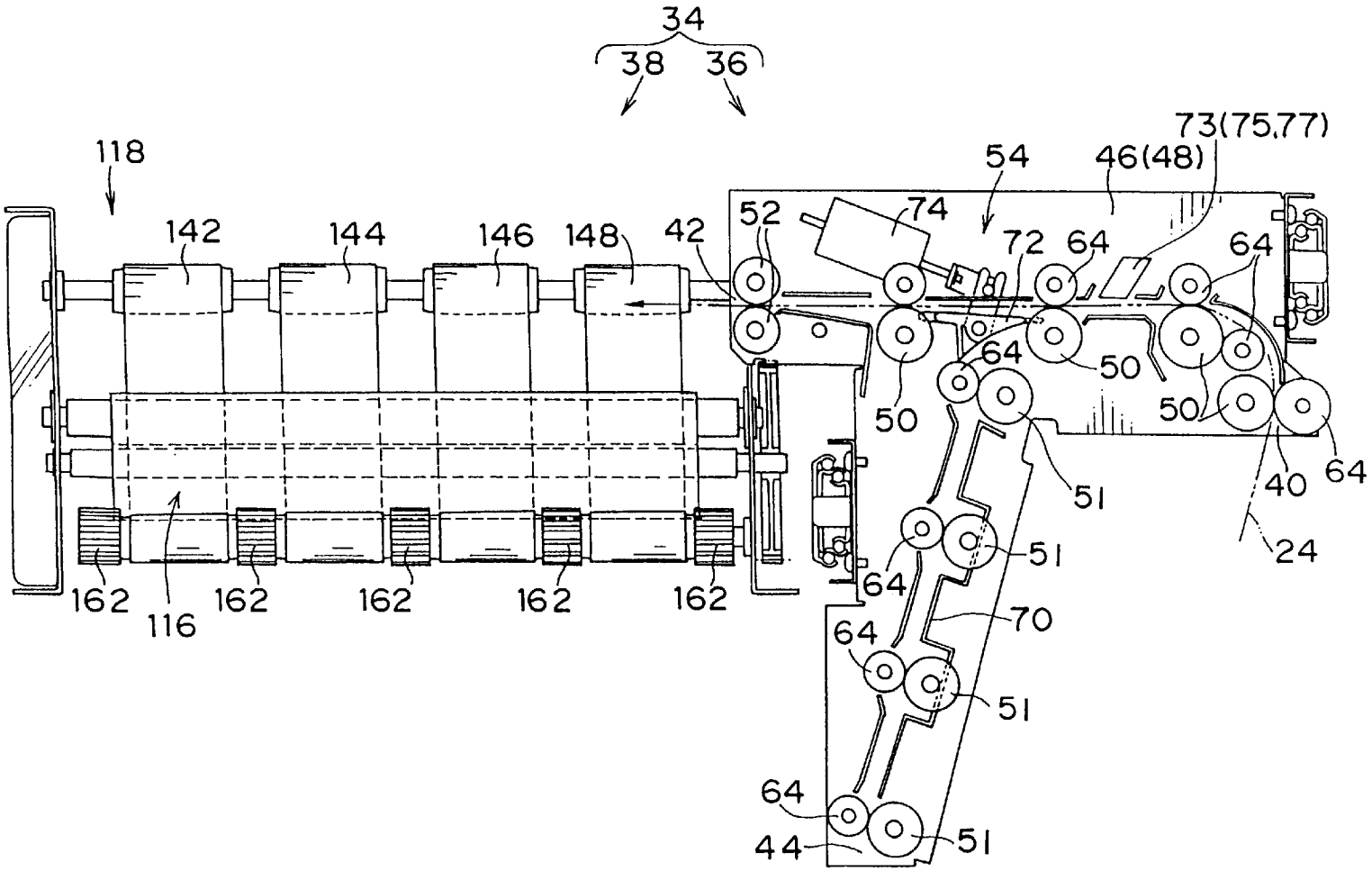
FIG. 4 is a front view that picks up the main portion of the sheet conveying apparatus according to the present invention and illustrates a schematic structural cross section of the sorting section thereof.
Figure 5:
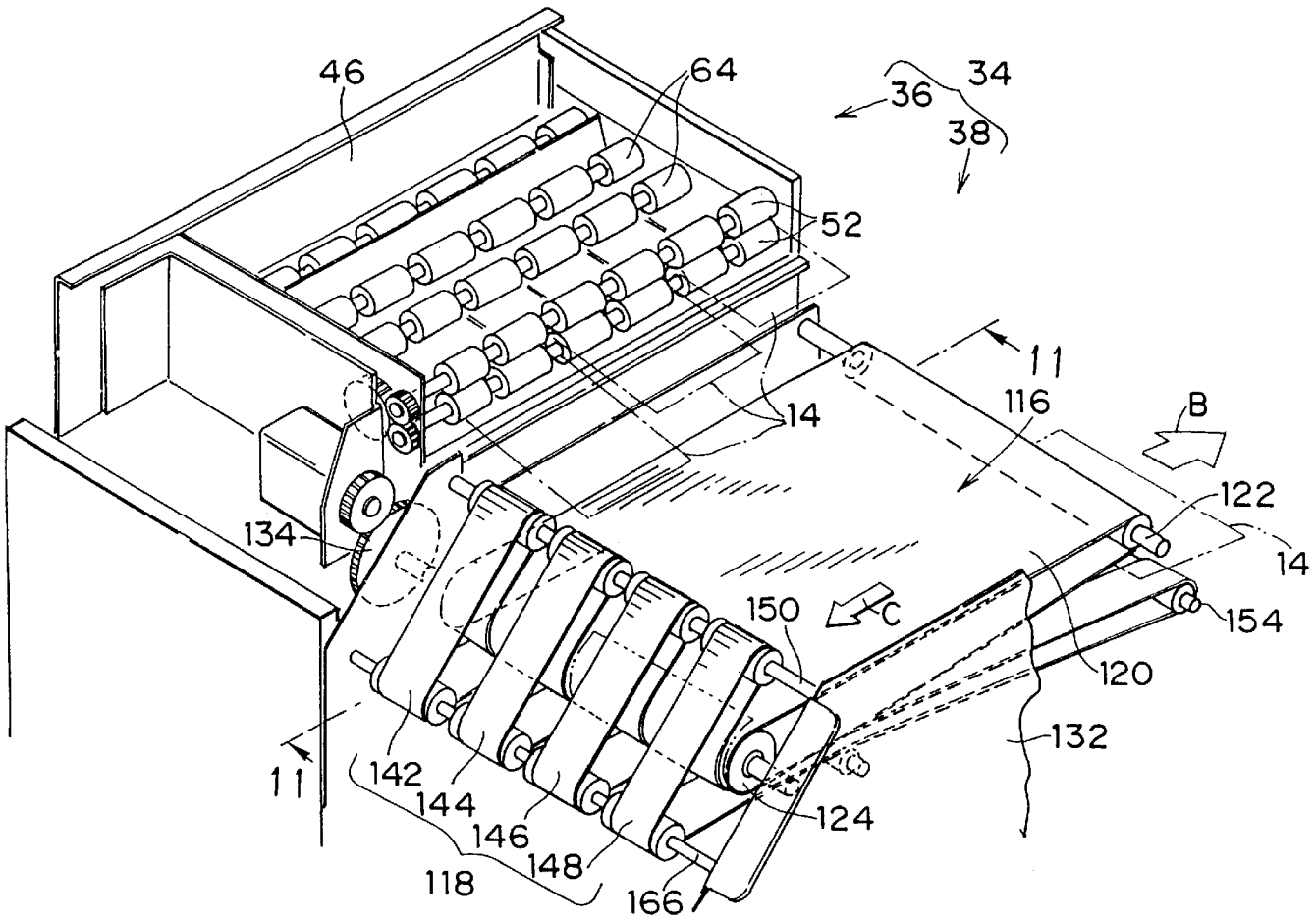
FIG. 5 is a schematic perspective view that picks up and illustrates the main portion of the sheet conveying apparatus according to the present invention.

As is also shown in FIGS. 4 and 5, the conveying section 34 comprises a sorting section 36 and a feeding section 38, serving as a conveying path portion. The sorting section 36 comprises a normal conveying path and a distinct conveying path. The normal conveying path is set as a conveying path in three rows extending from an inlet 40 for accepting the printing paper 14 which are fed along the conveying paths 24 from the drying section 32 side, to an outlet 42 for discharging a predetermined size of the printing paper 14 for an normal use. The distinct conveying path extends from the inlet 40 to an outlet 44 for discharging the printing paper 14 of a special size such as a large size or the like.

The normal conveying path in the sorting section 36 is set as a path that raises from the inlet 40 so as to extend continuously to the outlet 42 in the horizontal direction. The distinct conveying path in the sorting section 36 is set as a path that branches from a conveying path switching section 54 that is disposed on the midway from the inlet 40 to the normal conveying path so as to extend continuously to the outlet 44 obliquely downward.

In the sorting section 36, a plurality of conveying rollers 50 and 51, and a pair of outlet rollers 52 are mounted along the normal conveying path and the distinct conveying path so as to bridge over between side plates 46 and 48 each of which is formed in a substantially T shape when viewed from a side. Namely, the pair of the outlet rollers 52 are disposed at the outlet 42 portion of the normal conveying path. Other than this position, the conveying rollers 50 and 51 are disposed respectively at underside positions along the normal conveying path and the distinct conveying path so as to be spaced apart from one another at a substantially equal distance.

Figure 6:
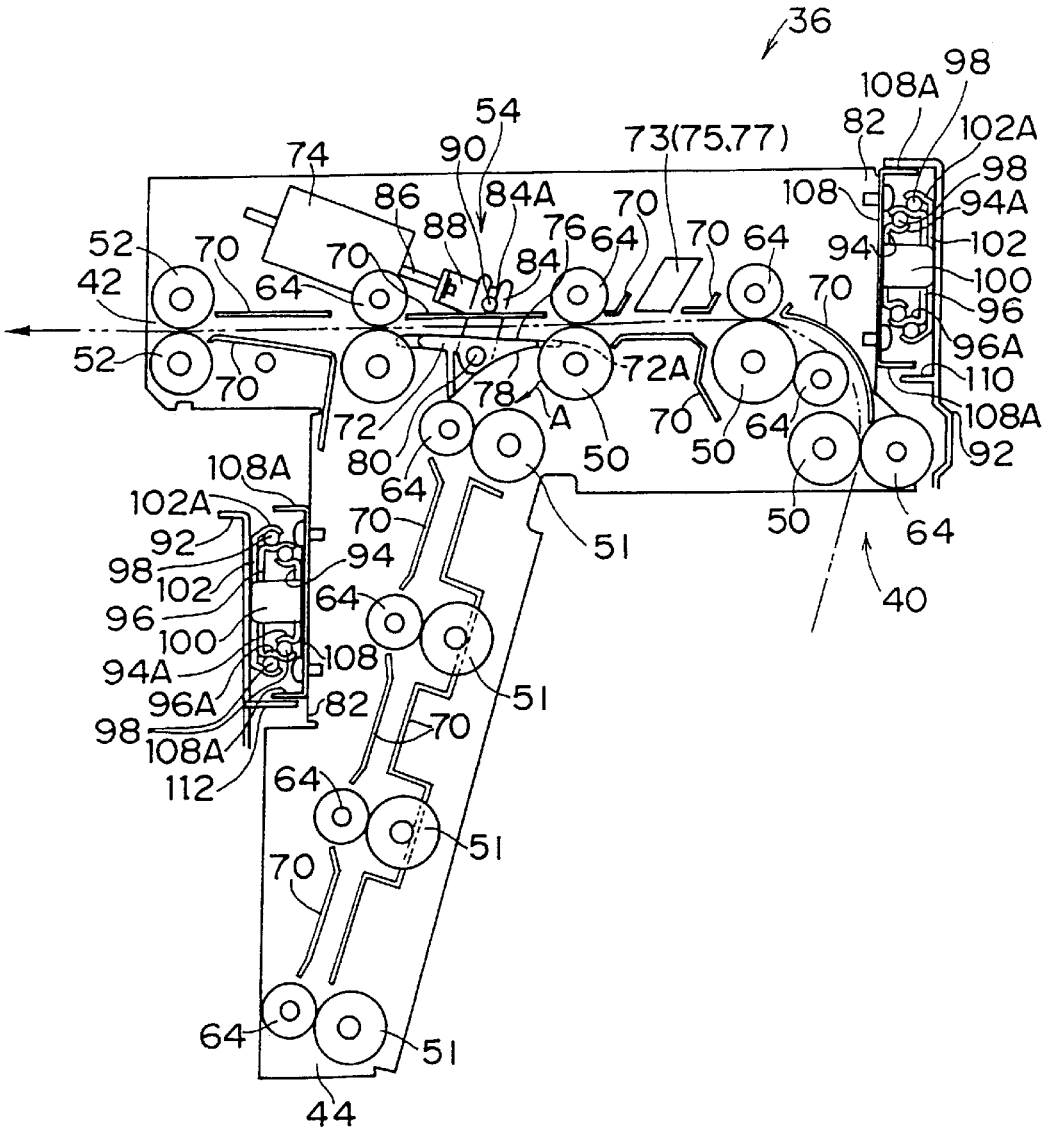
FIG. 6 is an enlarged front view that illustrates a schematic structural cross section of the sorting section in a state in which a normal conveying path is set, in the sheet conveying apparatus according to the present invention.
Figure 7:
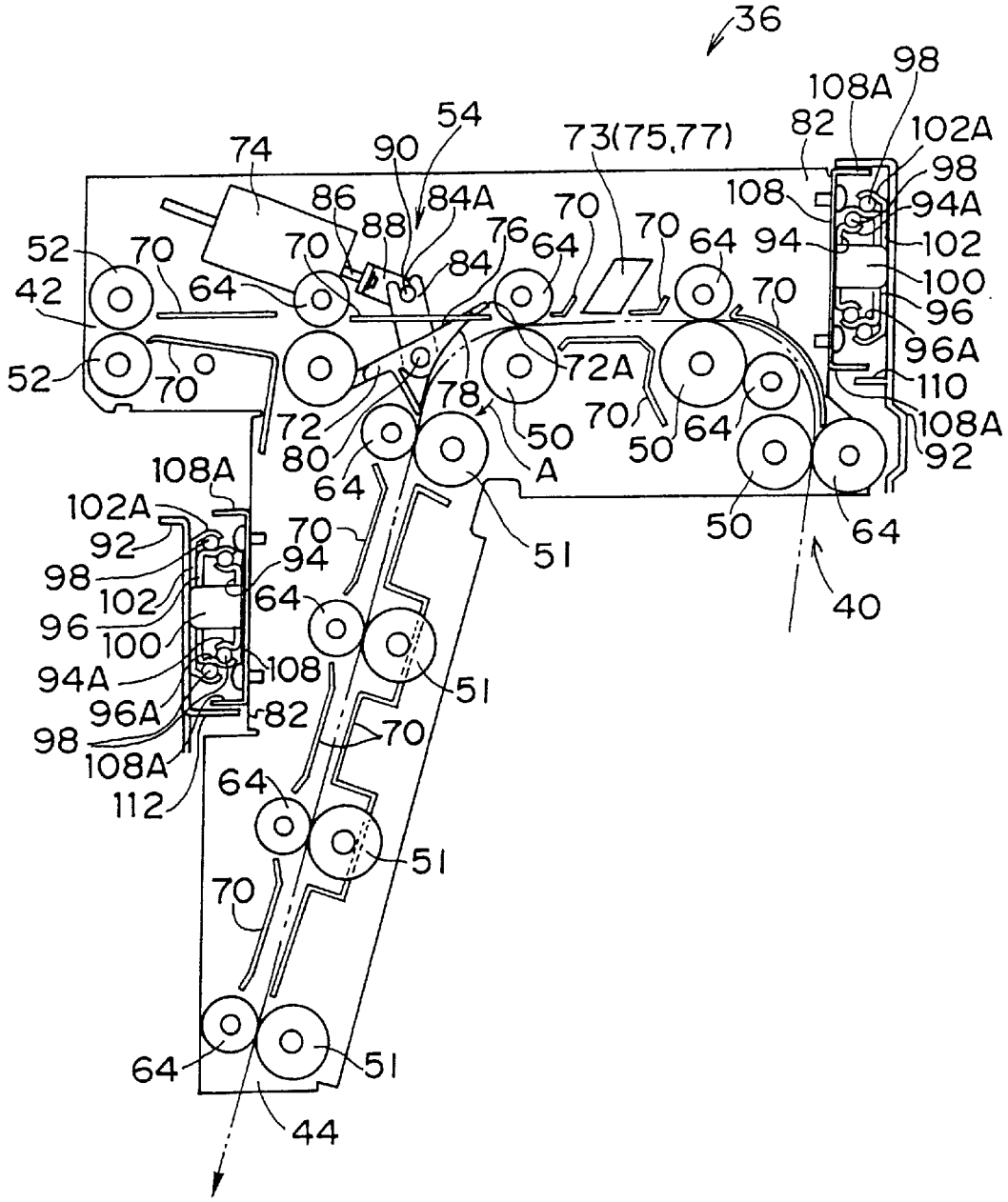
FIG. 7 is an enlarged front view that illustrates a schematic structural cross section of the sorting section in a state in which a distinct conveying path is set, in the sheet conveying apparatus according to the present invention.
Figure 8:
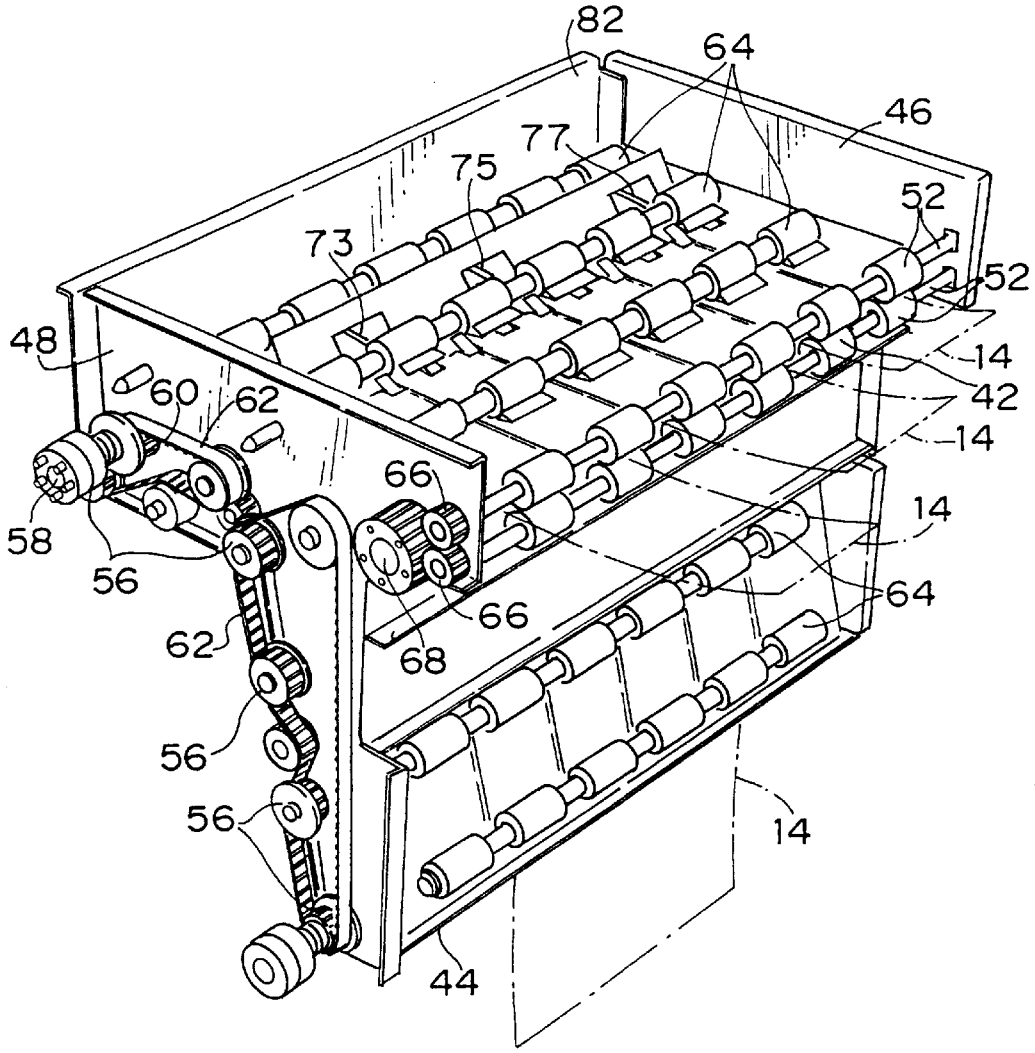
FIG. 8 is a perspective view that picks up and illustrates the sorting section in the sheet conveying apparatus according to the present invention.

As is shown in FIGS. 6 to 10, each of the conveying rollers 50 for the normal conveying path is formed by mounting a plurality of large diameter rubber roller members to a metal shaft at an equal distance. A one-way clutch is mounted between each of the rubber roller members and each of the shafts so as to allow the conveying rollers 50 to perform idle running in the conveying direction of the printing paper 14. Portions adjacent to both ends of the shaft of each of the conveying rollers 50 are rotatably supported by each of the side plates 46 and 48. Further, each of the conveying rollers 51 for the distinct conveying path is formed by fitting a plurality of large diameter rubber roller members onto a metal shaft at an equal distance. Moreover, both end portions of the shaft of each of the conveying rollers 51 are rotatably supported by each of the side plates 46 and 48. As is shown in FIG. 8, timing pulleys 56 are attached to end portions, piercing through the side plate 48, of the respective conveying rollers 50 along the normal conveying path. In addition, timing pulleys 56 are fixed directly to end portions, piercing through the side plate 48, of the respective conveying rollers 51 along the distinct conveying path extending from the conveying path switching section 54 to the outlet 44.

A timing belt 62 is entrained around a plurality of these timing pulleys 56, and a timing pulley 60 of a driving shaft 58. A rotational driving force is transmitted to the driving shaft 58 by the driving shaft 58 being connected to an unillustrated motor as a driving source therebetween by using a pin clutch so that each of the conveying rollers 50 and 51 rotates along the normal conveying path and the distinct conveying path rotates at the same time. Further, each of idlers 64, which is used by being mated with each of the conveying rollers 50 and 51, is axially mounted to each of bearing members. Each of the idlers 64 is made from a synthetic resin, has substantially the same configuration as each of the conveying rollers 50 and 51, and is mounted to each of the conveying rollers 50 and 51 in a state capable of performing idle running, respectively. This idler 64 is disposed such that a large diameter outer circumferential surface portion thereof rolls in contact with the rubber roller portion of each of the conveying rollers 50 and 51.

In this way, each of the conveying rollers 50 and 51 is structured such that, when each of the conveying rollers 50 and 51 is rotated by being mated with each of the idlers 64, each of the idlers 64 is thereby rotated by rolling in contact with each of the conveying rollers 50 and 51. Accordingly, the printing paper 14 is nipped into each of the idlers 64 and each of the conveying rollers 50 and 51, and then fed. Further, each of the conveying rollers 50 along the normal conveying path is rotated and driven through each of the one-way clutches so that each of the conveying rollers 50 can run idle in a direction in which it rotates at over speed due to such a movement as pulling out the printing paper 14 to the downstream in the conveying direction thereof, or the like. As a result, it is possible to carry out a movement of pulling out the printing paper 14 forcibly to the downward in the conveying direction at a higher speed.

Each of the pair of the outlet rollers 52, which are provided at the outlet 42 portion of the normal conveying path in the sorting section 36, is formed by fitting a plurality of large diameter rubber roller members onto metal shafts at a predetermined distance. Each of the end portions of the shaft is rotatably supported by each of the side plates 46 and 48. These pair of the outlet rollers 52 are formed in the same configuration, and are disposed so that each of the rubber roller members thereof rolls in contact with each other.

Pinions 66 of the same configuration are fixed to the end portions, piercing through the side plate 48, of the pair of the outlet rollers 52 in a state in which they mesh with each other. Further, a large diameter rotational speed increasing gear 68 meshes with one of the pinions 66.

This rotational speed increasing gear 68 is connected, rotated and driven such that the rotational frequency thereof can be changed by the unillustrated motor for driving each of the conveying rollers 50 and 51, through a clutch, a speed changing device, or the like. For this reason, the rotational speed increasing gear 68 is made to rotate at the same rotational frequency as that of each of the conveying rollers 50 and 51. However, since the rotational frequency is transmitted from the rotational speed increasing gear 68 to the pinions 66, while being increased, the pair of the outlet rollers 52 rotate at the rotational frequency that is higher than the conveying rollers 50 and 51. By controlling the speed changing device at an unillustrated control section, the pair of the outlet rollers 52 can be controlled so as to rotate at the same rotational frequency as the conveying rollers 50 and 51.

The pair of the outlet rollers 52, which have been structured as described above, rotate at a high speed in a state in which the printing paper 14 is nipped between the rubber rollers of the pair of the outlet rollers 52 while being gripped tightly. Accordingly, the printing paper 14 is made to spring from the outlet 42 and to be transferred to the feeding section 38 steadily, as will be later described. Further, during this springing-out movement of the printing paper 14, the conveying rollers 50 along the normal conveying path do not prevent the printing paper 14 from moving quickly and springing out, by running idle while nipping and feeding this printing paper 14.

As is shown in FIGS. 6 and 7, guide members 70 are disposed at positions among the conveying rollers 50 and 51 which are arranged adjacent to one another, along the normal conveying path and the distinct conveying path in the sorting section 36, for appropriately moving the leading edges of the pieces of printing paper 14 which have been fed from the upstream side conveying rollers 50 and 51 so as to be nipped into the downstream side conveying rollers 50 and 51.

Figure 9:
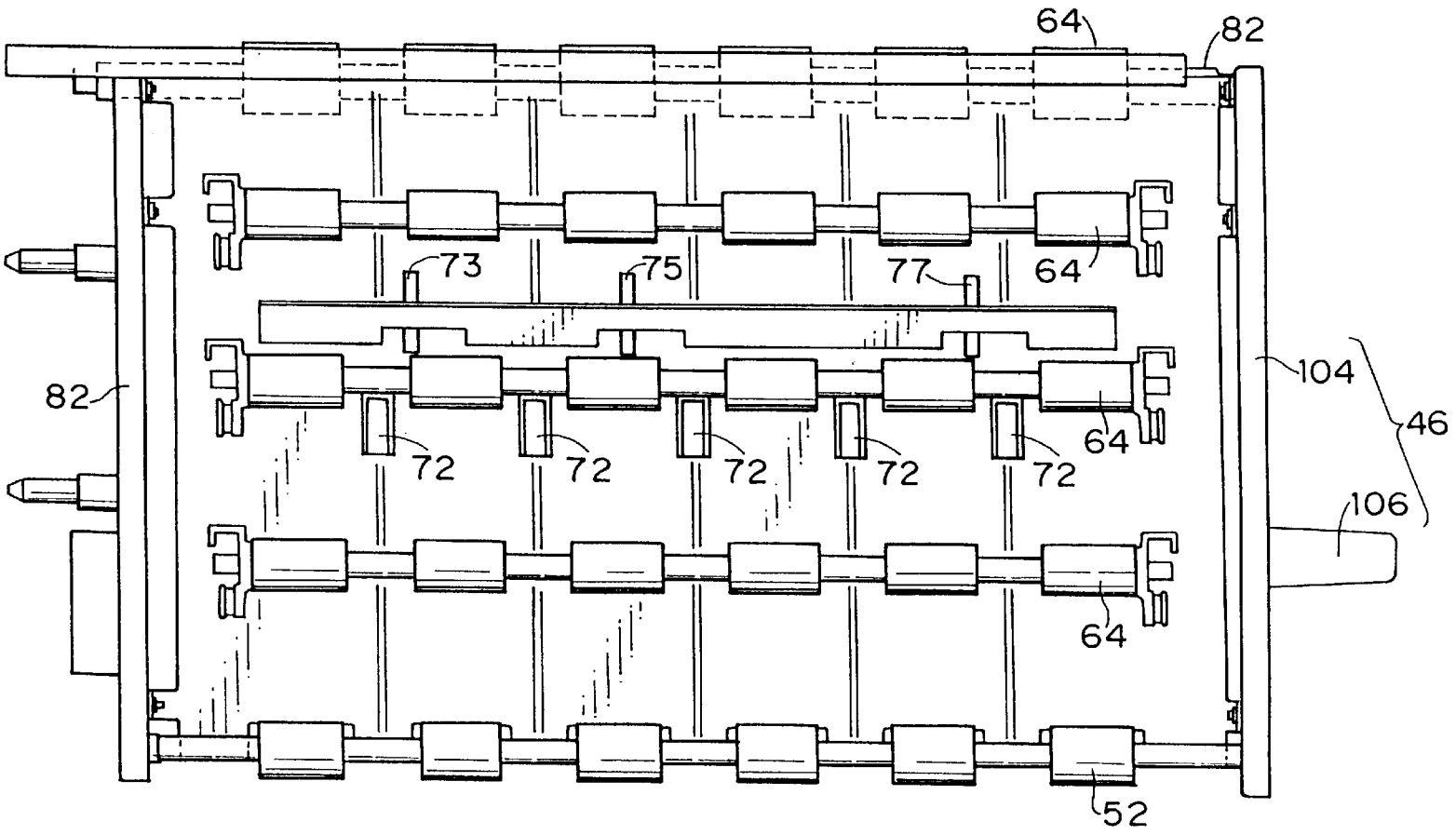
FIG. 9 is a schematic plan view of the sorting section in the sheet conveying apparatus according to the present invention.

As is shown in FIGS. 6, 7, and 9, three detectors 73, 75, and 77 for detecting the pieces of printing paper 14 are disposed between the inlet 40 and the conveying path switching section 54 along the conveying path in the sorting section 36. In order to detect each of pieces of the printing paper 14 which have been fed along each of the conveying paths set in three rows, separately from one another, using an optical means, or the like, these three detectors 73, 75, and 77 are disposed at positions corresponding to the respective rows of the conveying paths, so as to be spaced apart from one another at a required distance in the widthwise direction of each of pieces of the printing paper 14 orthogonal to the direction in which the pieces of printing paper 14 moves.

As is shown in FIGS. 6 and 7, the conveying path switching section 54 of the sorting section 36 is structured such that switching guide members 72 are operated by a so-called two way self-holding solenoid device 74. At this switching guide member 72 are formed a first guiding surface 76 that leads the printing paper 14 toward the normal conveying path, and a second guiding surface 78 that leads the printing paper 14 toward the distinct conveying path. This first guiding surface 76 is formed as a guiding surface so as to extend, in a substantially smooth manner, continuously from an upstream side tip end portion 72A of the normal conveying path in the switching guide members 72 to the downstream side thereof. Further, the second guiding surface 78 is formed in a concave curved shape that faces downward and that separates gradually from the upstream side tip end portion 72A of the normal conveying path to the downstream side thereof leading to an inlet of the distinct conveying path.

A plurality of switching guide members 72 (five in the present embodiment) are disposed so as to be fixed integrally with a shaft 80 that passes through the switching guide members 72 at the central portion thereof, at an equal distance, as is shown in FIG. 9. The end portions of this shaft 80 are rotatably supported by the side frames 46 and 48, respectively.

As is shown in FIGS. 6 and 7, a link plate 84 is disposed so as to protrude from a portion of the shaft bar 80 in such a manner that one end portion of the link plate 84 is pierced through by the shaft bar 80 and fixed thereto. The link plate 84 is formed in a small rectangular plate shape and at the free end portion thereof is formed a U-shaped interlocking groove 84A for interlocking with the solenoid device 74.

This solenoid device 74 is structured by a two way self-holding solenoid for general use. Namely, this solenoid device 74 is structured such that an unillustrated slider, which is formed integrally with a manipulation rod 86 inside a housing, is mounted so as to slide freely within a predetermined distance. This slider is attracted by one of unillustrated permanent magnets and held at a position where a maximum length of the manipulation rod 86 is protruded from the housing, while this slider is attracted by the other unillustrated permanent magnet and held at a position where the maximum length of the manipulation rod 86 is withdrawn into the housing. Further, an unillustrated electromagnet is provided at the slider, and the electromagnet is energized, and a repulsive force is generated between one of the permanent magnets by which the slider is attracted and the electromagnet itself so that the slider is moved by being attracted by the other permanent magnet, and thereby held.

An extension small plate 88 is provided so as to extend from a free end portion of the manipulation rod 86 of this solenoid device 74. A round shaft shaped interlocking pin 90 is disposed so as to protrude from a tip end portion of this extension small plate 88 in the direction orthogonal to an axis line of the manipulation rod 86. This interlocking pin 90 is inserted into an interlocking groove 84A of the link plate 84 so as to move slidably and rotatably therein, and the manipulation rod 86 of the solenoid device 74, and the link plate 84 are connected so as to interlock with each other so that the conveying path switching section 54 is formed.

In the conveying path switching section 54 which has been structured as described above, when the manipulation rod 86 is extended by operating and controlling the solenoid device 74, the shaft bar 80 is rotated at a predetermined angle through the link plate 84, and the switching guide members 72 are set in a state in which the printing paper 14 is guided to the normal conveying path side as is shown in FIG. 6. In this state, the tip end portions 72A of the switching guide members 72 are set in a state of being rotated to the corresponding conveying rollers 50 side (direction A in FIGS. 6 and 7). The first guiding surface 76, that faces substantially parallel to the guide members 70 along the normal conveying path, is guided such that the printing paper 14 is conveyed from the inlet 40 to the outlet 42 along the normal conveying path, and discharged from the outlet 42 side of the sorting section 36 which is shown in FIG. 8.

As is shown in FIG. 7, when the manipulation rod 86 is withdrawn to the housing side due to the operation and control of the solenoid device 74, the switching guide members 72 are set in a state in which the printing paper 14 is guided to the distinct conveying path side which is shown in FIG. 7, through the link plate 84 and the shaft bar 80. In this state, the tip end portions 72A of the switching guide members 72 are set in a state of being rotated to the corresponding idlers 64 side (direction opposite to arrow A of FIGS. 6 and 7). Also, in this state, since the second guiding plate 78 of the switching guide members 72 enters in a state of crossing over the normal conveying path, the printing paper 14, which has been fed from the inlet 40 into the conveying path, is led to the distinct conveying path by being guided by the second guiding surface 78, and conveyed along this distinct conveying path, and thereby discharged from the outlet 44 side of the sorting section 36 shown in FIG. 8.

In this way, in the conveying path switching section 54, when the two way self-holding solenoid device 74 capable of driving intermittently as described above is applied, since a switching operation at the conveying switching section 54 is not performed so often, usually, the solenoid device 74 can be used in a state of being not energized all the time. For this reason, it suffices that the solenoid device 74 with a large loading capacity made for a continuously rated use is not used. Further, since the solenoid device 74 is disposed near the drying section 32, it suffices that the solenoid device 74 with a large loading capacity is not used by considering that the temperature of the solenoid device 74 becomes high thus decreasing the attraction force of the solenoid device 74. As a result, an inexpensive and compact solenoid device 74 with a small loading capacity can be used.

Figure 10:
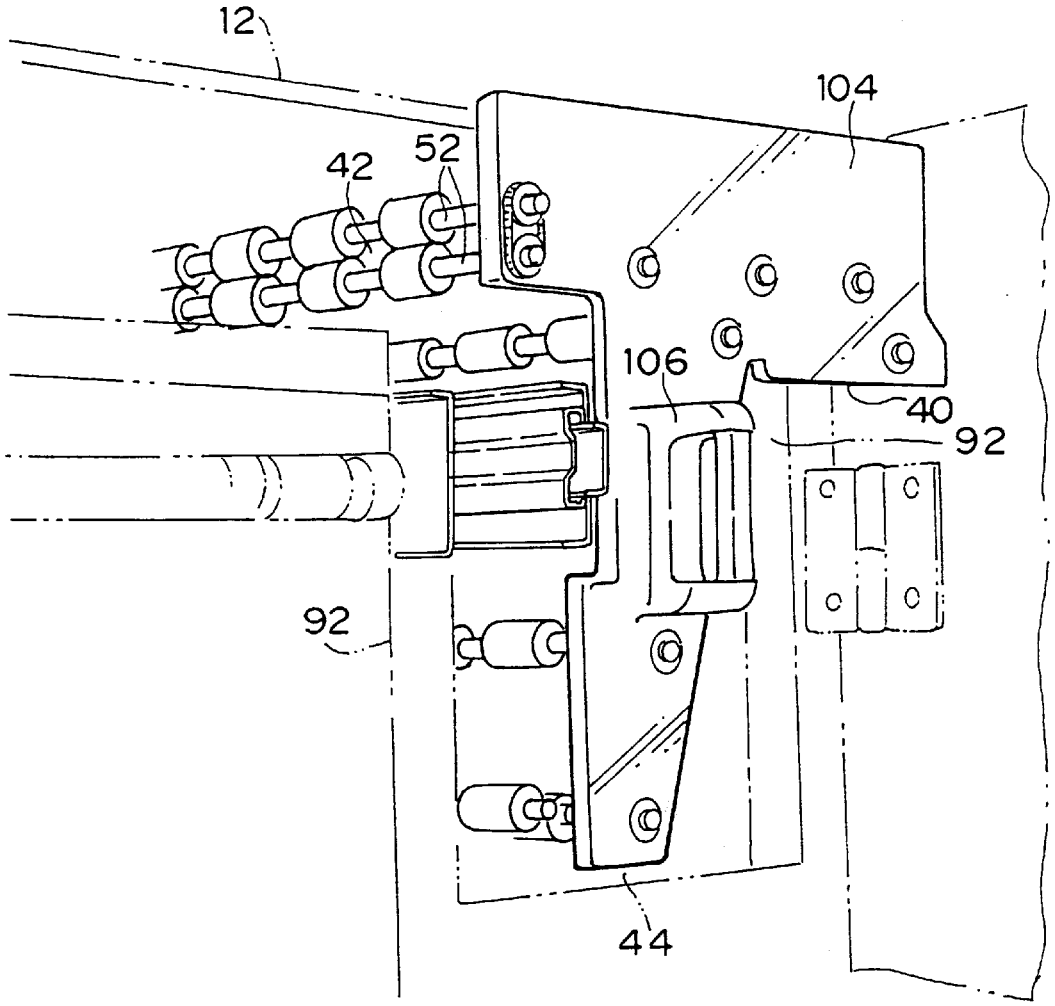
FIG. 10 is a main portion schematic perspective view that illustrates a portion of the sorting section at a handle side in the sheet conveying apparatus according to the present invention.

As is shown in FIGS. 1, 4, and 10, the sorting section 36 can be mounted so as to be drawn out solely from the main body of the processor section 12 for a maintenance or the like. For this reason, the sorting section 36 is mounted to a frame 92 of the processor section 12 so as to be slidable therewith by slide support mechanisms. The slide support mechanisms are disposed respectively at a side portion of a frame 82 adjacent to the inlet 40 of the conveying path, and at a side portion between the two outlets 42 and 44 of the conveying path opposite to the side portion of the frame 82. Each of the slide support mechanisms is disposed along the direction parallel to the axis line of each of the conveying rollers 50 and 51 of the sorting section 36.

Each of the slide support mechanisms is structured as below. Both side portions 94A of each of small rail members 94 which is fixed to the frame 82 of the sorting section 36 and whose cross section is formed in a small substantially U-shaped configuration, are fitted into both side portions 96A of each of middle rail members 96 whose cross section is a middle substantially U-shaped configuration. A plurality of rotors 98 are interposed among the both side portions 94A, and the both side portions 96A corresponding to each of the both side portions 94A so that the middle rail member 96 is able to move freely and slidably with respect to the small rail member 94. Further, a moving amount controlling member 100 is mounted between the small rail member 94 and the middle rail member 96 so that the middle rail member 96 is thereby controlled so as not to fall from the small rail member 94 by sliding.

Further, in each of the sliding supporting mechanisms, both side portions 96A of the middle rail member 96 are fitted into both side portions 102A of a large rail member 102 whose cross section is formed into a large substantially U-shaped configuration and which is fixed to the frame 92 of the processor section 12. A plurality of rotors 98 are interposed among the both side portions 102A and the both side portions 96A corresponding to the respective both side portions 102A so that the middle rail member 96 is able to move freely and slidably with respect to the large rail member 102. Further, a moving amount controlling member 100 is mounted between the large rail member 102 and the middle rail member 96. The middle rail member 96 is thereby controlled so as not to fall from the large rail member 102 by sliding.

In the sorting section 36 which is supported by the two slide support mechanisms which have been structured as described above, substantially the whole portion of the sorting section 36 can be drawn out from the processor section 12 in a state in which the small rail member 94, the middle rail member 96, and the large rail member 102 support the sorting section 36 while sliding relatively with one another.

As described above, owing to the structure in which the sorting section 36 can be pulled out from the processor section 12, when jamming of the printing paper 14 is caused at the sorting section 36, the printing paper 14 that has caused the jamming can easily be taken out by pulling this sorting section 36 from the processor section 12.

As is shown in FIGS. 6, 7, and 10, auxiliary supporting structures are provided at portions adjacent to each of the slide support mechanisms of the frame 82 of the sorting section 36 and the frame 92 of the processor section 12, respectively. In order to form each of the auxiliary supporting structures, a first bracket 108 is disposed at the frame 82 of the sorting section 36 in the longitudinal direction of each of the small rail members 94. The first bracket 108 has the same length as the frame 82.

This first bracket 108 is formed in a substantially U-shaped cross section, and is fixed to the frame 82 in a state in which the small rail members 94 are disposed in parallel at the widthwise direction central portion of the bottom surface of the concave portion of the U-shaped cross section. Further, each of free end side portions 108A at both side portions of the first bracket 108 is disposed outwardly from the side portions of the large rail member 102 of the slide support mechanism.

A second bracket 110 for the auxiliary supporting structure is provided near the slide support mechanism in the frame 92 of the processor section 12, which is provided near the inlet 40 of the sorting section 36. This second bracket 110 is structured so as to protrude upright from the frame 92 which is formed integrally therewith at a position outside each of the free end side portions 108A of the first bracket 108 corresponding to the second bracket 110, and to have substantially the same length as the free end side portion 108A and be parallel thereto.

A third bracket 112 for the auxiliary supporting structure is provided near the slide support mechanism in the frame 92 of the processor section 12, which is provided toward a position between the two outlets 42 and 44 of the sorting section 36. This third bracket 112 is formed integrally with the frame 92 and raises therefrom, at a position externally downward from the free end side portions 108A at the lower side of the first bracket 108 that corresponds to this third bracket 112, and to have substantially the same length as the free end side portion 108A and be parallel thereto.

In this way, if the auxiliary supporting structures (108, 110, and 112) are provided between the sorting section 36 and the frame 92, when an assembling work of the sorting section 36 at a high position of the processor section 12 is performed, a connection and assembling work in each of portions of the slide support mechanisms can be performed in a state in which the second bracket 110 and the third bracket 112 are mounted on the first bracket 108 each of the second bracket 110 and the third bracket 112 corresponds to. Accordingly, a single operator can perform this assembling work. With this, even when the slide support mechanisms displace from the sorting section 36, the sorting section 36 is held by the first, second and third brackets 108, 110, and 112 so that the sorting section 36 is prevented from falling from the processor section 12 thus ensuring a double safety.

As shown in FIG. 10, a side plate portion 104 that forms a part of a side plate 46 which corresponds to the front side toward which the sorting section 36 is pulled out is made from a resin and is formed in a thick plate shape. Further, at the side plate portion 104 is provided a handle integrally therewith. This is because the sorting section 36 is located above the drying section 32 and is set in a state of being easily heated. If the side plate portion 104 of the frame 82 is made from a metal, when the sorting section 36, just having been used, is pulled out by a user, there may be a case that the side plate portion 104 and the handle 10 are too hot to be touched by a user. Therefore, the side plate portion 104 and the handle 106 portion are formed by a resin material thus preventing these portions from becoming too hot to be touched.

In this way, if only the side plate portion 104 of the side plate 46 is made from a resin material and the other portion thereof is made from a metal, when there is a difference between thermal expansion coefficients of the metallic portion and the resin portion of the side plate 46, due to the difference between thermal expansion coefficients, positions for supporting the conveying rollers 50 and 51, the outlet rollers 52, and the idlers 64 which are laid so as to bridge over the metallic side plate portion 104 and the resin side plate portion 104 are caused to displace (misalignment of each of rollers). As a result, there are caused possibilities that the sorting section 36 malfunctions.

Each of the materials used is selected such that the thermal expansion coefficients of a metallic material for forming the side plate 46 of the sorting section 36 and a resin material for forming the side plate portion 104 of the side plate 46 substantially correspond to each other. In the present embodiment, because a stainless steel is used for a metal for forming the side plate 46, the thermal expansion coefficient thereof is about $1\times10^{-5}$. In accordance with this, a resin such as a polyamide resin which contains glass fiber and whose thermal expansion coefficient is about $1.5\times10^{-5}$ is used. By taking the assembling accuracy of the sorting section 36 into consideration, when a stainless steel material is used for the side plate 46, it is clear from the results of analysis that the side plate portion 104 can be formed by a resin material having a thermal expansion coefficient that is less than or equal to $2\times10^{-5}$.

By the side plate 46 being structured as described above, even when the sorting section 36 is heated, it is possible to carry out an operation in which the sorting section 36 is pulled out by an operator grabbing the handle 106 so that the sorting section 36 can be prevented from malfunctioning due to distortion caused by the thermal expansion.

In the sorting section 36 having been structured as described above, the printing paper 14, which has been dried at the drying section 32, is fed from the inlet 40 onto the conveying paths. While being fed along the conveying paths, each of pieces of the printing paper 14 is detected by the three detectors 73, 75, and 77 about whether it is fed along each of the three rows of the conveying paths, timing when it was fed, a size such as width and length, the number of sheets, or the like.

In the case in which the size of the printing paper 14 which has been detected by the three detectors 73, 75, and 77 is less than or equal to a so-called pet size (152 mm in width and 254 mm in feeding length), the normal conveying path is set by the conveying path switching section 54 being operated, and the printing paper 14 is transferred while being guided on the first guiding surface 76 of the switching guide members 72, and then fed from the exit 42 side to the feeding section 38 side. At this time, each of the printing paper 14 is made to spring out from the outlet 42 by the outlet conveying rollers 52 that rotate relatively at a high speed, and to be transferred onto the feeding section 38 so that the printing paper 14 being fed in sequence do not overlap with one another.

When the printing paper 14 having a relatively short width and a relatively long length (e.g. a panoramic size) has been detected to be fed along the conveying paths in sequence, the outlet rollers 52 are controlled by an unillustrated control section so as to rotate at the same rotational frequency as that of the conveying rollers 50 and 51. And the long printing paper 14 is fed to the feeding section 38 without idling the conveying rollers 50 on the normal conveying path. Further, in this case, the outlet rollers 52 receives substantially the same amount of load as the conveying rollers 50.

When a plurality of pieces of the relatively long printing paper 14 are fed along the three rows of the conveying paths in a staggered arrangement, distances among the long printing paper 14, which are displaced from one after another along the three rows of the conveying paths, sufficiently increases. Even if these pieces of long printing paper 14 are not discharged from the outlet 42 at a high speed, any inconvenience is not caused to the arrangement state of each of the printing paper 14 at the feeding section 38. Accordingly, in the case of the long printing paper 14, it becomes unnecessary to discharge the printing paper 14 by springing them out from the outlet 42 at a high speed. When the pieces of long printing paper 14 are discharged from the outlet 42 at a high speed, the number of stages of the conveying rollers 50 along the normal conveying path also increases by rolling in contact with the entire length of the printing paper 14 at the same time. Accordingly, a number of these conveying rollers 50 perform idling at a high speed, the resistance from the idling increases and acute exhaustion is thereby caused to the rollers.

When such pieces of long printing paper 14 are conveyed successively, the pair of the outlet rollers 52 are controlled to decrease their rotational frequency to that which is the same as the conveying rollers 50 and 51. By doing this, the exhaustion of the outlet rollers 52 is suppressed and life during use is extended so that a low torque small motor can be used as a motor for rotating and driving the outlet rollers 52. As a result, an inexpensive product can be manufactured.

Further, in this sorting section 36, if each of the printing paper 14, which have been fed from the inlet 40, is detected to be larger than a pet size of paper, to be a splice paper, to be a print for managing and maintaining an exposure processing section, to be a broke or the like, by the detectors 73, 75, and 77 or other detecting means, the control section sets the distinct conveying path by operating the conveying path switching section 54. The pieces of printing paper 14 are fed from the inlet 40 while being guided by the second guiding surface 78 of the switching guide members 72 and are discharged onto an accumulation tray 114 mounted to the main body of the processor section 12 which is shown in FIG. 1.

As is shown in FIGS. 1, 4, and 5, at the conveying section 34 is provided the feeding section 38 so as to be connected to the outlet 42 of the normal conveying path in the above-described sorting section 36. This feeding section 38 is mainly formed by a receiving side belt portion 116 and a feeding side belt portion 118 that are combined integrally with each other so as to inverse the top and the rear of the printing paper 14 during the conveyance thereof.

This receiving side belt portion 116 is formed by entraining an endless belt 120 as a piece of large width endless belt around the first and second rotational shafts 122 and 124 so as to convey the printing paper 14 in the direction orthogonal to the conveying direction along the normal conveying path in the sorting section 36.

Figure 11:
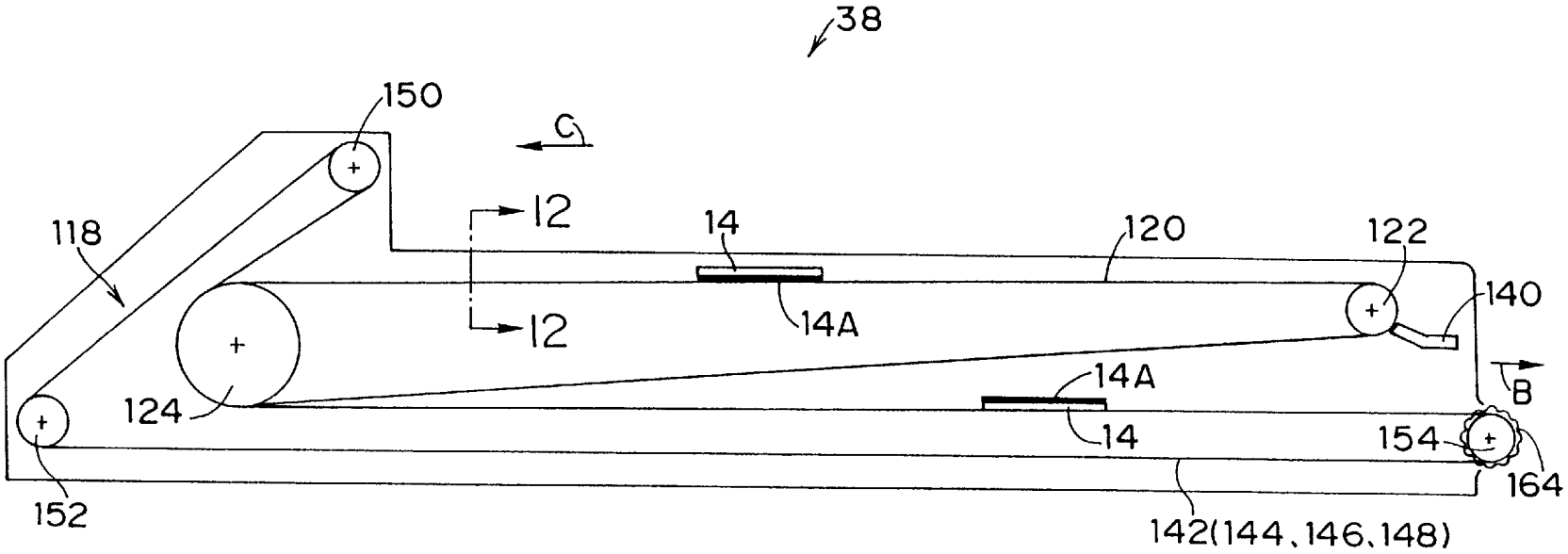
FIG. 11 is a schematic side view that illustrates a schematic structure of an endless belt corresponding to the cross section taken along line 11—11 in FIG. 5.

As is shown in FIGS. 5 and 11, the first rotational shaft 122 is a relatively thin driven shaft, and is axially fixed to the outlet side end portion of the feeding section 38, at which the printing paper 14 is fed in the direction arrow B so that the end portions of the first rotational shaft 122 rotate freely. Further, the second rotational shaft 124 is a relatively thick driving shaft, and is disposed at the returning end portion at the side opposite to the outlet side of the feeding section 38.

Figure 14:
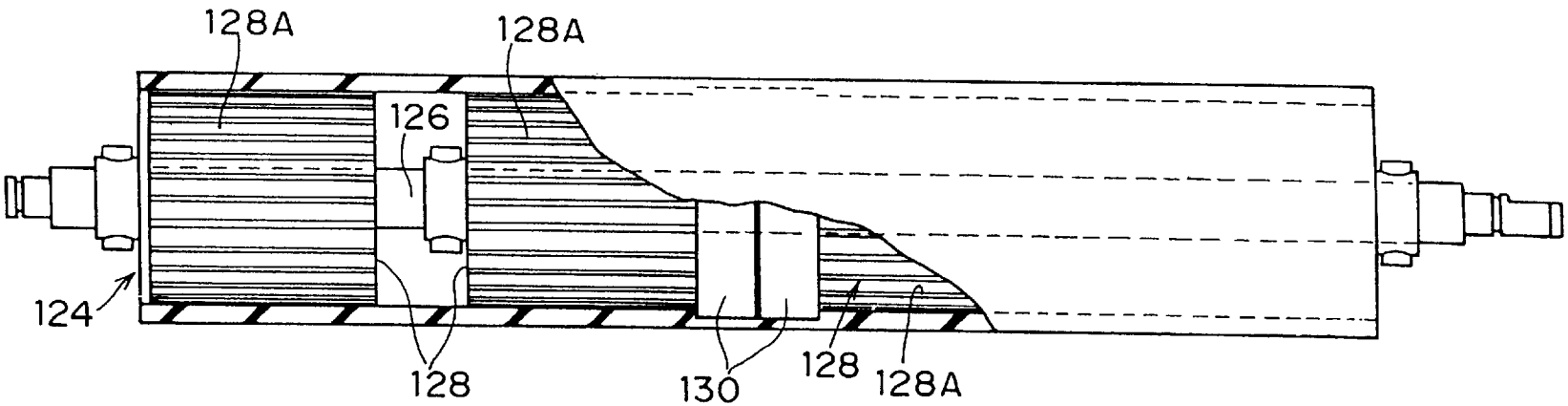
FIG. 14 is a partial cross-sectional front view that picks up and illustrates a second rotational shaft in the sorting section of the sheet conveying apparatus according to the present invention.
Figure 15:
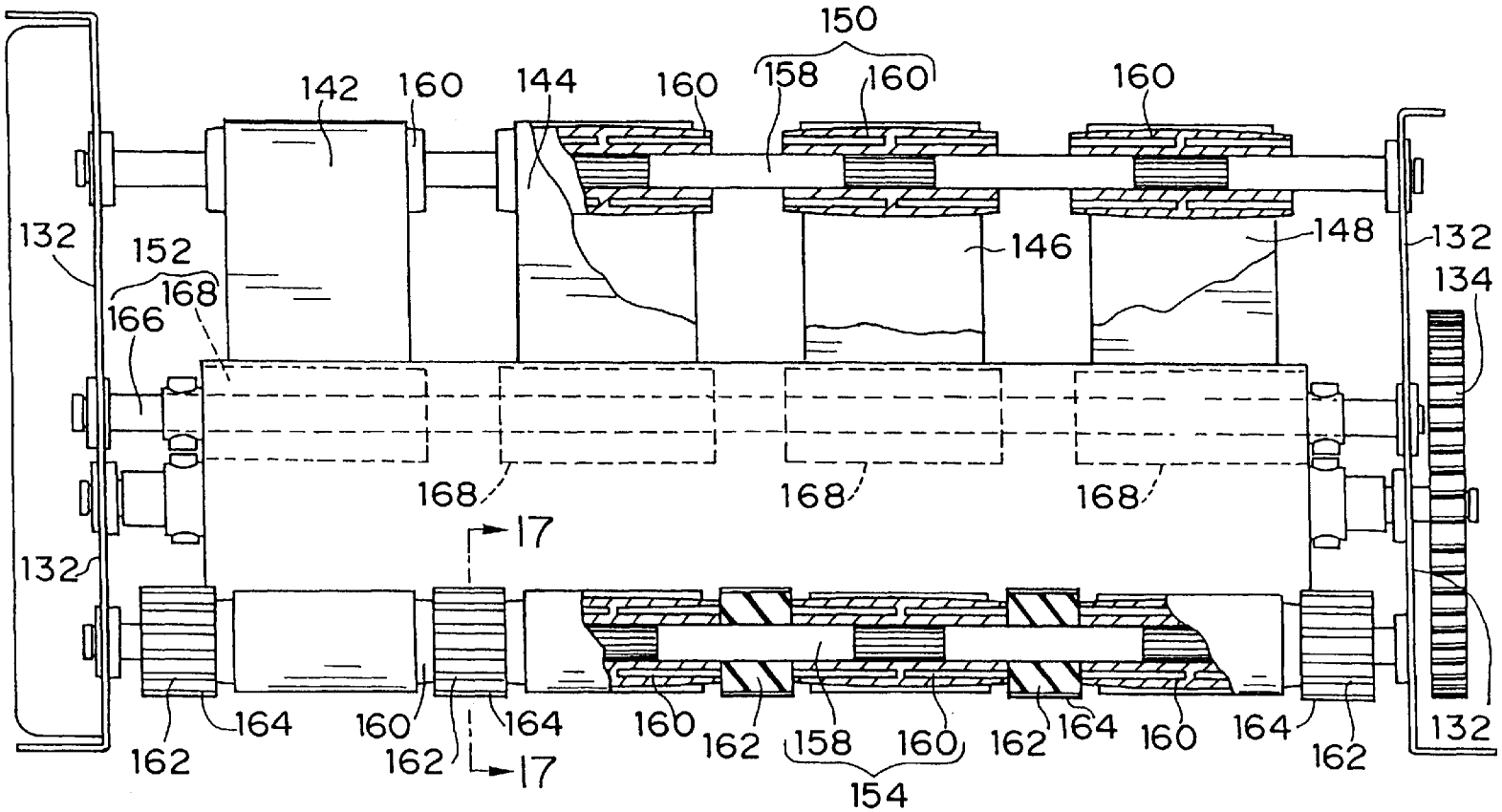
FIG. 15 is an enlarged partial cross-sectional front view that illustrates a portion of a feeding section of the sheet conveying apparatus according to the present invention.

As is shown in FIG. 14, this second rotational shaft 124 is fixed to a shaft bar 126 such that a plurality of (four in the present embodiment) cylindrical gear portions 128, each of which has a teeth form 128A formed at the outer circumferential portion thereof, are disposed so as to be spaced apart from each other at a predetermined distance. Further, a pair of cylindrical guide pulley portions 130, each of which has an outer circumferential surface whose diameter is slightly larger than that of a tip circle of each of the gear portions 128, are fixed side by side to the lengthwise direction central portion of the shaft 126. As is shown in FIG. 15, each of the end portions of this second rotational shaft 124 is rotatably supported by frames 132 in the feeding section 38. A gear 134, around which a timing belt that interlocks with a driving source such as an unillustrated motor or the like is entrained, is fixed to one of the end portions of the frame 132, extending outwardly therefrom.

Figure 12:
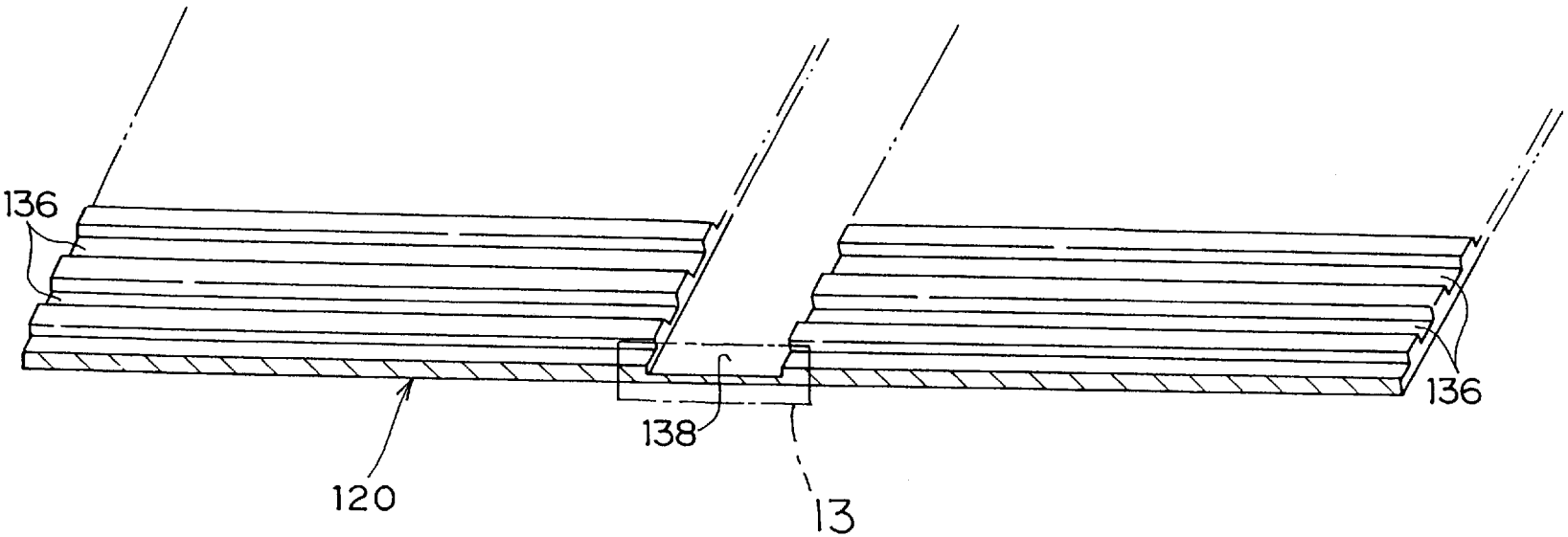
FIG. 12 is a main portion enlarged perspective view that illustrates a portion of the endless belt at the rear side thereof corresponding to the cross section taken along line 12—12 in FIG. 11.
Figure 13:
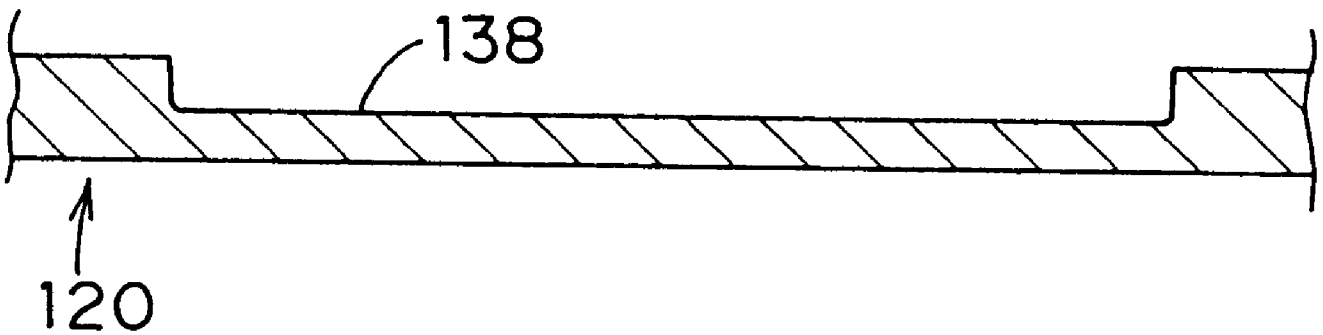
FIG. 13 is an enlarged perspective view that illustrates a main portion of the endless belt which is surrounded by a dashed line 13 in FIG. 12.

As is shown in FIG. 12, at the internal peripheral surface portion of the endless belt 120 which is entrained around the first and second rotational shafts 122 and 124 are formed teeth grooves 136 which mesh with the teeth forms 128A of the gear portions 128. Further, as is also shown in FIG. 13, at the widthwise direction central portion on the internal peripheral surface of the endless belt 120, is formed a predetermined width of a guiding groove 138 so as to extend along the direction in which the endless belt 120 rotates. The endless belt 120 thus formed is such that the teeth grooves 136 thereof mesh with the teeth forms 128A, in a state in which the endless belt 120 is entrained around the second rotational shaft 124, and then is set in a state in which the pair of the guide pulley portions 130 enter into the full width of a groove of the guiding groove 138.

By the second rotational shaft 124 being rotated and driven, a power is transmitted between the gear portions 128 and the endless belt 120 without causing any slide therebetween so that this endless belt 120 rotates between the first and second rotational shafts 122 and 124. During a rotating movement of the endless belt 120, because the pair of the guiding pulley portions 130, having entered into the guiding groove 138, guide the movement of the endless belt 120 in the widthwise direction thereof so as to be restricted, this endless belt 120 performs its rotational movement in a stable manner in the widthwise direction thereof, without snaking. Moreover, the guiding pulley portions for guiding the guiding groove 138 can be provided at the firs rotational shaft 122.

As can be seen from FIG. 5, in the feeding section 38, the printing paper 14, which has been fed from the outlet 42 of the sorting section 36 so as to be sprung out therefrom, in a state in which the endless belt 120 of the receiving side belt portion 116 is made to rotate, drops and rides on the endless belt 120 such that a photographic printing surface (image forming surface) of the printing paper 14 abuts the outer peripheral surface of the endless belt 120, and then conveyed. At this time, since the direction in which the printing paper 14 is fed from the sorting section 36 and the direction in which the endless belt 120 conveys the pieces of printing paper 14 are orthogonal to each other, when the printing paper 14 is transferred onto the endless belt 120, the posture of the printing paper 14 displaces to one side from a position where the printing paper 14 is supposed to land on the endless belt 120, turns, or the like. As a result, there are possibilities that the printing paper 14 may be conveyed in a state of being mounted on the endless belt 120 at a position different from a predetermined position where the printing paper 14 is supposed to be mounted.

In this way, if the printing paper 14 is conveyed in the state of being mounted on the endless belt 120, displacing from a predetermined mounting position on the endless belt 120, when the printing paper 14 passes through a returning portion on conveying path, a folded line may be formed at an extruded portion of the printing paper 14 from the conveying path, or jamming may cause until the printing paper 14 is transferred onto the feeding side belt portion 118 and then discharged. For this reason, the printing paper 14 which has been fed from the outlet 42 of the sorting section 36 must be transferred onto the endless belt 120 with a proper posture.

However, in the structure which is shown in FIGS. 4 and 5, when the conveying speed of the endless belt 120 is made to be low, the speed of the whole processing line of the processor section 12 must be decreased, and processing capacity deteriorates, accordingly. Further, the displacement of the printing paper 14 can be prevented by halting the movement of the endless belt 120 only when the printing paper 14 is dropped on the endless belt 120. However, in order to do this, an intermittent driving movement of the endless belt 120 must be performed due to an extremely quick switching operation thus making apparatuses or controls involved in these movement complicated.

Therefore, a frictional resistance amongst the printing paper 14, a photographic printing surface abutting the endless belt 120, of the printing paper 14, and the endless belt 120 is increased. The printing paper 14, which has dropped from the sorting section 36 onto the endless belt 120, is received by the endless belt 120 on the top surface thereof so as not to displace the posture or the position thereof from a predetermined mounting position due to this increased frictional resistance.

Figure 18:
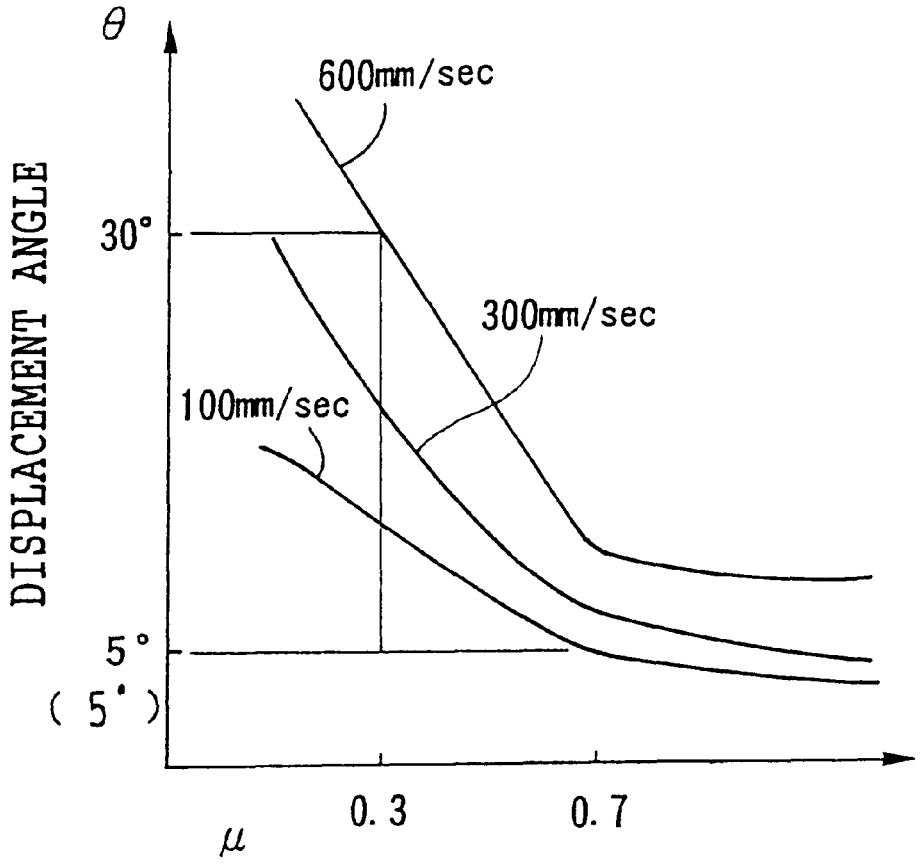
FIG. 18 is an explanatory diagram that illustrates a relationship among a frictional coefficient on the surface of the endless belt, a conveying speed at which the endless belt is conveyed, and a displacement angle of the endless belt with respect to the printing paper in the sheet conveying apparatus according to the present invention.

For this reason, when a relationship amongst a friction coefficient $\mu$ on the top surface of the endless belt 120, a displacement angle $\theta$ of the printing paper 14 from the predetermined mounting position of the printing paper 14 transferred onto this endless belt 120, and a moving speed on the external surface of the endless belt 120 is determined through an experiment, such results as shown in FIG. 18 are obtained. As can be seen from this FIG. 8, when the frictional coefficient $\mu$ on the surface of the endless belt 120 is less than or equal to about 0.7, a fluctuation rate of the displacement angle $\theta$ of the printing paper 14 becomes small rapidly. Further, even when the value of the moving speed of the endless belt 120 varies from 100 mm/s to 600 mm/s, if the frictional coefficient $\mu$ on the surface of the endless belt 120 is less than or equal to about 0.7, the displacement angle $\theta$ of the printing paper 14 becomes less than or equal to 10°, and thereby becomes within a range of a tolerance in use of the displacement angle $\theta$.

Practically, it is preferable that the frictional coefficient $\mu$ on the surface of the endless belt 120 is made to be greater than or equal to 0.7. For this reason, in the present embodiment, the endless belt 120 is made from a rubber material, and in order to increase the frictional coefficient, a processing process such as forming of concave and convex portions or increasing of a surface roughness, or the like is applied on the outer peripheral surface portion of the endless belt 120 as needed.

Since the above-described endless belt 120 has the teeth grooves 136 formed on the inner peripheral surface thereof, a thickness from the outer peripheral surface to each of the teeth mountain tops at the inner peripheral surface side, of the endless belt 120, is large. However, a flexibility of the belt appropriately can increase as compared to a flat belt having a thickness that is the same as that of this endless belt 120 and in which teeth grooves are not formed so that the large increase of the tensional force of the endless belt 120 becomes unnecessary. As a result, as compared to a structure in which an endless belt is entrained around shafts with a large tensional force, the endless belt of the present invention can be made compact by decreasing a strength of the frames 132. In addition, since each of the teeth mountain top portions of the teeth grooves 136 formed on the inner peripheral surface of the endless belt 120 is thick, this portion can provide the belt in the widthwise direction with an appropriate rigidity so that the outer peripheral surface of the endless belt 120 can be prevented from being wrinkled. As a result, wrinkles, that are formed on the printing paper 14 in such a manner that the printing paper 14 is inverted in a state of being mounted on wrinkles that are formed on the outer peripheral surface of the endless belt 120, and then pressed to the wrinkles by the feeding side belt portion 118, which will be later described, can be prevented.

The snaking of the endless belt 120 is prevented by the guide pulley portions 130 entering into the guiding grooves 138 formed at the inner peripheral surface portion of the endless belt 120, and rotating therein. This is suitable for the case when it is difficult to guide both side end portions of the endless belt 120 by collars of the pulleys.

As is shown in FIG. 11, a guiding member 140 is disposed so as to strip off and discharge the printing paper which has been fed while being stuck adhesively to the endless belt 120, at the outlet side of the feeding section 38, where the first rotational shaft 122 is, without abrading the printing paper 14. This is done in order to prevent the printing paper 14 from being conveyed again from the first rotational shaft 122 at the upward side of the endless belt 120 to the second rotational shaft 124 while being stuck adhesively to the outer peripheral surface of the endless belt 120 entrained around the first rotational shaft 122 and moving in the direction arrow B at the downward side of the endless belt 120.

As is shown in FIGS. 5 and 11, in cooperation with the receiving side belt portion 116 that has been structured as described above, the feeding side belt portion 118, which inverts the top and the rear of the printing paper 14 and feeds the paper 14 to the outlet side, forms a conveying path that rotates from the upward to the downward of a returning end portion of the endless belt 120 so as to extend to the outlet side.

In order to form means for inverting the top and the rear of the printing paper 14, this feeding side belt portion 118 must move with the endless belt 120 in a state in which it press-contacts with the outer peripheral surface of a portion of the endless belt 120 which is entrained around the second rotational shaft 124, and must perform a rotating movement without snaking. For this reason, the conveying path is formed by a plurality of rows (four in the present embodiment) of flat belts which are thin and narrow.

In order to form the conveying path by using such four belts 142, 144, 146, and 148 as described above, as is shown in FIG. 11, the conveying path comprises: an inlet side roller member 150 which is disposed to the diagonally upward of the second rotational shaft 124 in FIG. 11; an intermediate roller member 152 which is disposed to the diagonally left and downward of the second rotational shaft 124 in FIG. 11; and a clean-up roller member 154 which is disposed at the outlet side end portion (the right end position in FIG. 11) so as to be spaced apart from the first rotational shaft 122.

As is shown in FIG. 15, the inlet side roller member 150 is structured by fitting and inserting crown rollers 160 into each of the positions corresponding to the conveying paths of the four flat belts 142, 144, 146, and 148 and fixing the crown rollers 160 to the flat belts 142, 144, 146, and 148 so as to rotate integrally with each other. Further, end portions of a shaft bar 158 are axially fixed to the frames 132.

The clean-up roller member 154 is structured by fixing the crown rollers 160 to each of the positions corresponding to each of the conveying paths of the four flat belts 142, 144, 146, and 148 of the shaft bar 158 whose end portions are axially fixed to the frames 132, and by disposing clean-up rollers 162 at positions to the outside of the crown rollers 160 at the ends thereof and at positions between the crown rollers 160 adjacent to each other and set apart from each other at a predetermined distance, respectively.

Each of the crown rollers 160, which are disposed at these inlet side roller member 150 and the clean-up roller member 154, is structured such that an intermediate portion of a rim portion thereof is made high so as to form a drum shape so that the flat belts 142, 144, 146, and 148 entrained around the crown rollers 160 are prevented from falling off from the crown rollers 160 or from snaking. Further, the length of each of the crown rollers 160 in the direction of the rotational axis is formed so as to be slightly longer than the width of each of the flat belts 142, 144, 146, and 148.

Figure 16:
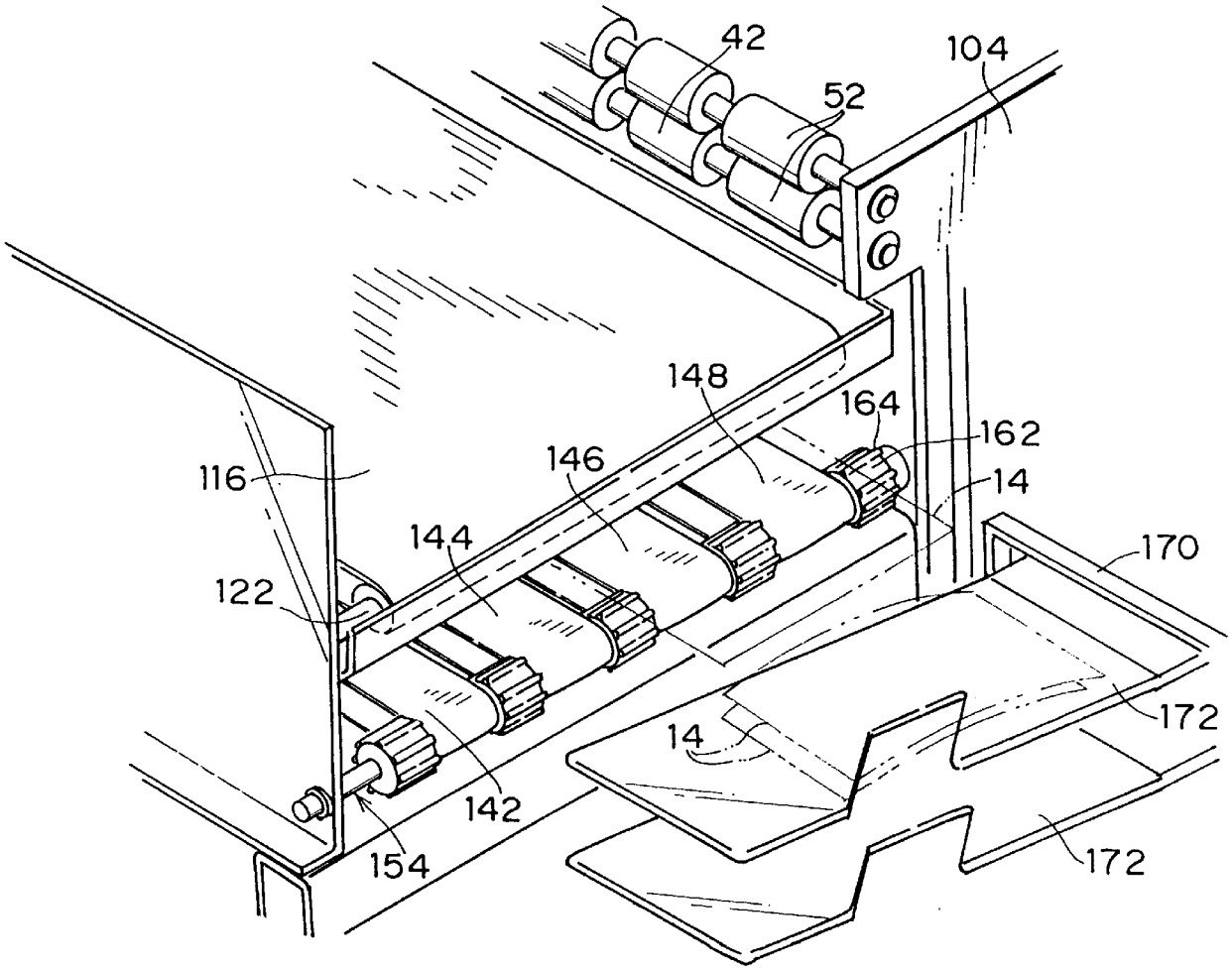
FIG. 16 is a main portion enlarged perspective view that illustrates an outlet portion of the feeding section in the printer processor having the sheet conveying apparatus according to the present invention.
Figure 17:
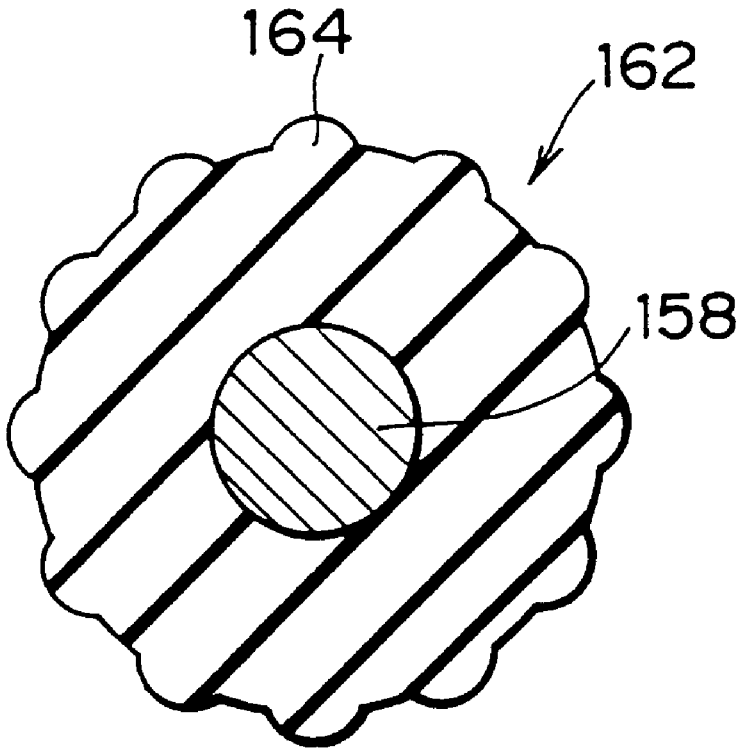
FIG. 17 is an enlarged cross-sectional view that illustrates the cross section of a clean-up roller, taken along line 17—17 in FIG. 15.

As is shown in FIGS. 15 to 17, protruding portions 164 are formed integrally with the clean-up rollers 162 which are disposed at the clean-up roller member 154. Each of the protruding portions 164 protrudes from a thick and cylindrical outer circumferential portion of each of the clean-up rollers 162 so as to form a rail along a thrust direction and to be spaced apart therefrom at a predetermined distance. A radius of a circle of each of the clean-up rollers 162 that internally contacts with each of the plurality of the protruding portions 164 is formed to be sufficiently larger than a distance in which a thickness of each of the flat belts 142, 144, 146 and 148 is added to a maximum radius of each of the crown rollers 160.

As is shown in FIGS. 5 and 15, the intermediate roller member 152 is structured such that thick and cylindrical guide rollers 168 are fitted by insertion to be integrated with the four flat belts 142, 144, 146 and 148 on a shaft bar 166 whose end portions are fixed axially to the frames 132 at respective positions corresponding to the conveying paths of the four flat belts 142, 144, 146 and 148. Instead of the guide rollers 168, crown rollers can be used for the intermediate roller member 152.

The four flat belts 142, 144, 146, and 148, each of which is formed in a narrow width endless belt shape, are entrained in parallel to one another, around the three inlet side roller member 150, intermediate roller member 152, and clean-up roller member 154, each of which is structured as described above. As is shown in FIG. 11, the flat belts 142, 144, 146, and 148 are entrained by a route such that they press-contact with the outer peripheral surface of the endless belt 120 which is entrained from the inlet side roller member 150 to the second rotational shaft 124 at a central angle of about 180°, are thereby entrained around the clean-up roller member 154 and returned, then entrained around the intermediate roller member 152, and thereafter, entrained around the inlet side roller member 150. As a result, the four flat belts 142, 144, 146, and 148 are entrained in an endless state via the above-described route so that a conveying path of the printing paper 14 is formed.

On the conveying path of these flat belts 142, 144, 146, and 148, the first rotational shaft 122 and the clean-up roller member 154 at the outlet side are spaced apart from each other. Accordingly, the endless belt 120 and the flat belts 142, 144, 146, and 148 separate from each other at a predetermined angle, from a portion of the returning end portion of the second rotational shaft 124 at which the endless belt 120 and the flat belts 142, 144, 146, and 148 contact with each other, to the outlet side. As a result, a distance between the endless belt 120 and the flat belts 142, 144, 146, and 148 at the outlet side is structured so as to prevent the printing paper 14 from being transferred from the four flat belts 142, 144, 146, and 148 toward the endless belt 120.

Because the flat belts 142, 144, 146, and 148 are in a state of being entrained around the second rotational shaft 124 through the endless belt 120, when this second rotational shaft 124 drives to rotate, they perform a rotating movement around the conveying path due to the friction that is caused between the outer peripheral surface of the endless belt 120, and the outer peripheral surfaces of the flat belts 142, 144, 146, and 148 that press-contact therewith.

In the feeding section 38 which has been structured as described above, a plurality of pieces of the printing paper 14 are fed in a staggered arrangement along the conveying paths set in three rows in the sorting section 36 as is shown in FIG. 5, and sequentially fed from the outlet 42 side to the feeding section 38 side. Namely, the plurality of the printing paper 14, which have been fed from the sorting section 36 in a staggered arrangement, are fed in sequence in which the conveying direction leading edge of each of the printing paper 14 is forwarded ahead to the conveying direction downstream side. At this time, timing at which the plurality of pieces of the printing paper 14 are fed into the feeding section 38 so as to correspond to a length of the longitudinal distance between the leading edges of two printing paper 14 whose conveying direction leading edges are closest to each other is staggered. For this reason, each of pieces of the printing paper 14 is fed to the feeding section 38, intermittently.

At this time, at the feeding section 38, since the endless belt 120 at the receiving side belt portion 116 is in the course of movement, while rotating all the time, the printing paper 14, which have been fed from the outlet 42 of the sorting section 36 and mounted onto the endless belt 120, are immediately transferred to the conveying direction downstream side. Since the pieces of printing paper 14 are fed intermittently, the next printing paper 14, which has been fed from the outlet of the sorting section 36 at a timing staggered, is mounted on an empty portion of the endless belt 120 after the previous printing paper 14 has been conveyed and then conveyed to the downstream side. In this way, the printing paper 14, which are fed intermittently from the sorting section 36, are fed away by the endless belt 120 in sequence to the downstream side. As a result, the printing paper 14, which are fed intermittently from the three rows of the conveying paths in the sorting section 36, are fed sequentially so as to form a line along the endless belt 120.

The printing paper 14, which have been transferred from the sorting section 36 to the endless belt 120 as described above, move along the endless belt 120 in the direction arrow C as is shown in FIGS. 5 and 11. At the second rotational shaft 124 side of the returning end potion of the endless belt 120, each of the printing paper 14 inverts by rotating from the upper side to the lower side of the outer circumference of the second rotational shaft 124 in a state it is nipped into the endless belt 120 and the flat belts 142, 144, 146, and 148. Namely, the printing paper 14, which has been transferred from the sorting section 36 onto the outer peripheral surface at the upper side of the conveying path of the endless belt 120, is set in a state of being mounted such that an image forming surface (emulsion surface) of the printing paper 14 faces downward.

The printing paper 14 strips off and falls from the outer peripheral surface of the endless belt 120, which has now become the lower side conveying path of the endless belt 120, by rotating semi-circle along the outer circumference of the second rotational shaft 124 in a state of being nipped between the endless belt 120 and the flat belts 142, 144, 146, and 148, and then mounted on the flat belts 142, 144, 146, and 148 at the feeding side belt portion 118. The printing paper 14, having been mounted on the flat belts 142, 144, 146, and 148, is set in a state in which the image forming surface 14A thereof faces upward, and the user of this apparatus can see an image. And the printing paper 14, having been mounted on the flat belts 142, 144, 146, and 148, is conveyed in the direction arrow B, and is pulled out and separated from the outer peripheral surface of the flat belts 142, 144, 146, and 148 by being lifted therefrom by the protruding portions 164 of the clean-up rollers 162 when it passes through the clean-up roller member 154 at the outlet side end position, as is shown in FIG. 16. Further, when the conveying direction rear edge portion of the printing paper 14 which is fed to the outlet side by the flat belts 142, 144, 146, and 148, is about to pass through a portion of the clean-up roller member 154, the conveying direction rear edge portion of the printing paper 14 is struck by the protruding portions 164 of the clean-up rollers 162, and the printing paper 14 is thereby pushed and then discharged onto a tray 172 of a sorter section 170 that is disposed adjacent to this outlet.

Accordingly, jamming is prevented from being caused by the rear edge portion of the printing paper 14 being rolled into the clean-up roller member 154. Namely, even when the printing paper 14 is set in a state of being kept in close contact with the flat belts 142, 144, 146, and 148 by a static (static electricity), because the printing paper 14 is pulled out and separated from the flat belts 142, 144, 146, and 148 due to the operation of the protruding portions 164 of the clean-up rollers 162, the rear edge of the printing paper 14 is pushed so that the printing paper 14 is thereby discharged. As a result, the printing paper 14 can be discharged reliably.

During the conveying operation of the printing paper 14 at the above-described feeding section 38, when the printing paper 14 is kept in close contact with the endless belt 120 by static, the printing paper 14, which has been kept in close contact with the endless belt 120, is fed from the second rotational shaft 124 toward the outlet, where the first rotational shaft 122 is, in the direction arrow B, in a state in which it is stuck to the lower side of the endless belt 120. In this case, as described before, the printing paper 14, that is stuck to the endless belt 120, is stripped off of the endless belt 120 in a state of being entrained around the first rotational shaft 122, by the guiding member 140 that faces the endless belt 120 and then fed onto the tray 172.

Since the distance between the outlet side end portion of the endless belt 120 where the first rotational shaft 122 exists, and the outlet side where the clean-up roller member 154 at the flat belts 142, 144, 146, and 148 exists is formed to be widened enough, it is possible to prevent the printing paper 14, which has been transferred onto the flat belts 142, 144, 146, and 148, from being withdrawn to the endless belt 120 side. For example, in the case in which a portion of the endless belt 120 adjacent to the outlet side contacts with the flat belts 142, 144, 146, and 148, a frictional force of the endless belt 120 is greater than that of the flat belts 142, 144, 146, and 148, there are possibilities that the printing paper 14 may displace from the flat belts 142, 144, 146, and 148 and be fed to the first rotational shaft 122 side together with the endless belt 120; however, such possibilities can be prevented.

The sorter section 170 for accumulating the printing paper 14, which has been fed from the feeding section 38, is structured in such a manner as described below. A plurality of the trays 172 are mounted to a crawler-shaped conveying means as is shown in FIG. 3, and are fed downwardly from the outlet 174 side of the feeding section 38 in sequence. The trays 172 turn at the lowest end portion thereof and then fed again to the outlet 174 side. When one of the tray 172 that is disposed directly below the outlet 174 is filled with the printing paper 14, this tray 172 moves one step downwardly, and an empty tray 172 is newly set above this tray 172 so as to receive the printing paper 14 that comes next. Further, a user takes printing paper 14 mounted on the tray 172 out at his or her discretion while the tray 172 having this printing paper 14 mounted thereon moves to the lowest position located directly beneath the outlet 174.

Figure 19:
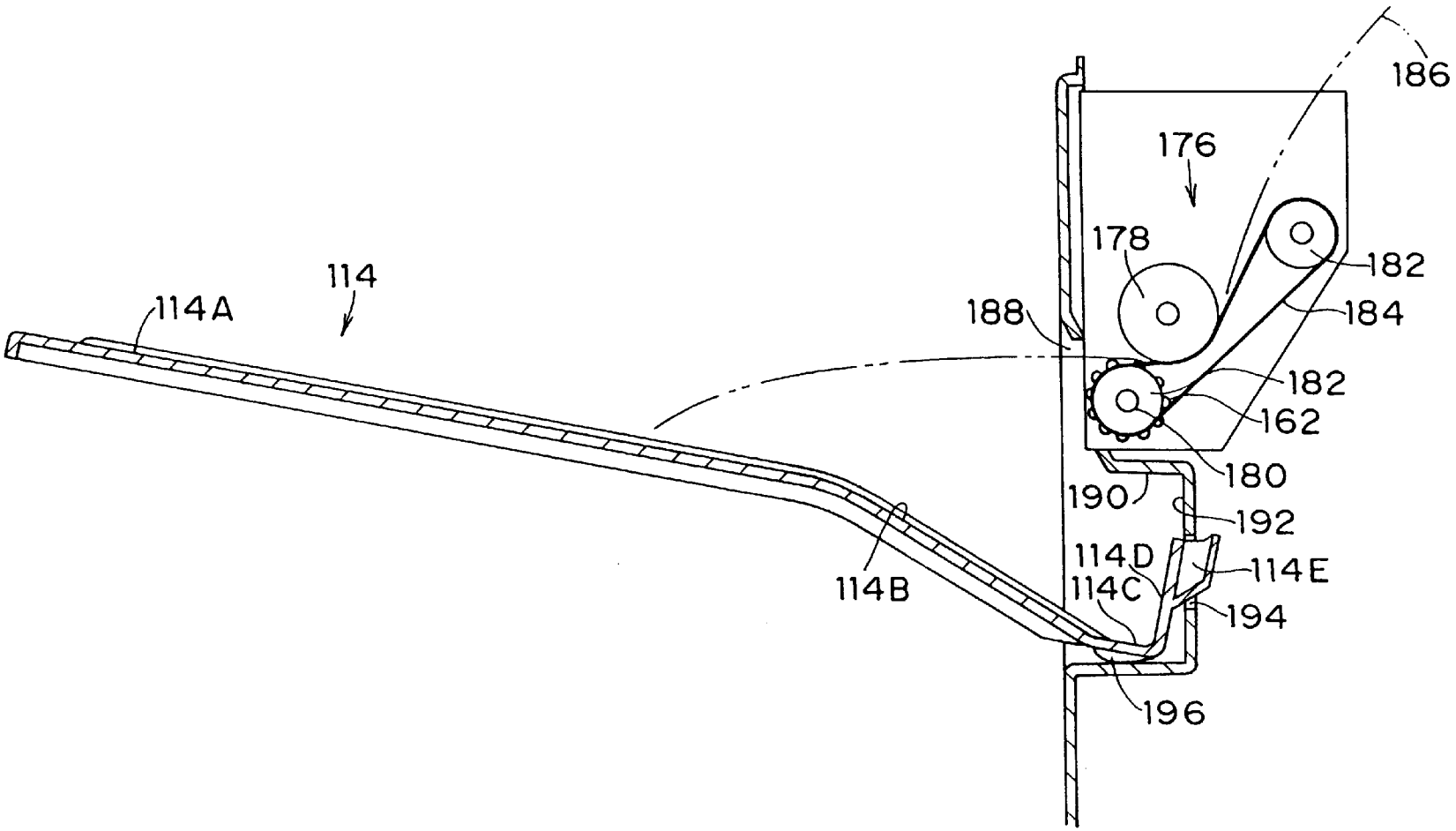
FIG. 19 is a cross-sectional view that illustrates a portion in which the printing paper is fed from the distinct conveying path side up to an accumulation tray in the sorting section of the printer processor having the sheet conveying apparatus according to the present invention.
Figure 20:
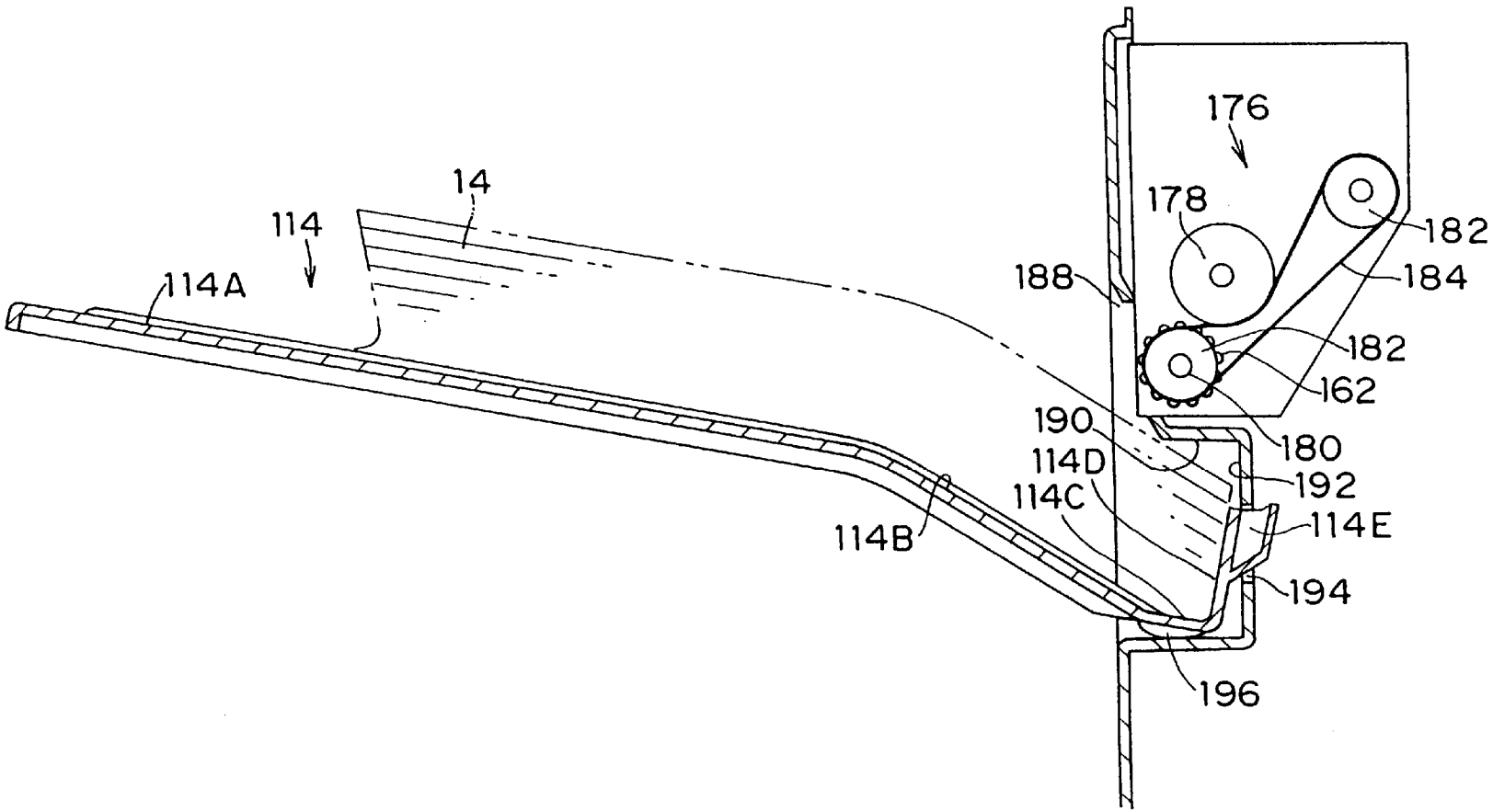
FIG. 20 is a cross-sectional view that illustrates a state in which a long size printing paper is accommodated from the distinct conveying path side onto the accumulation tray in the sorting section of the printer processor having the sheet conveying apparatus according to the present invention.
Figure 21:
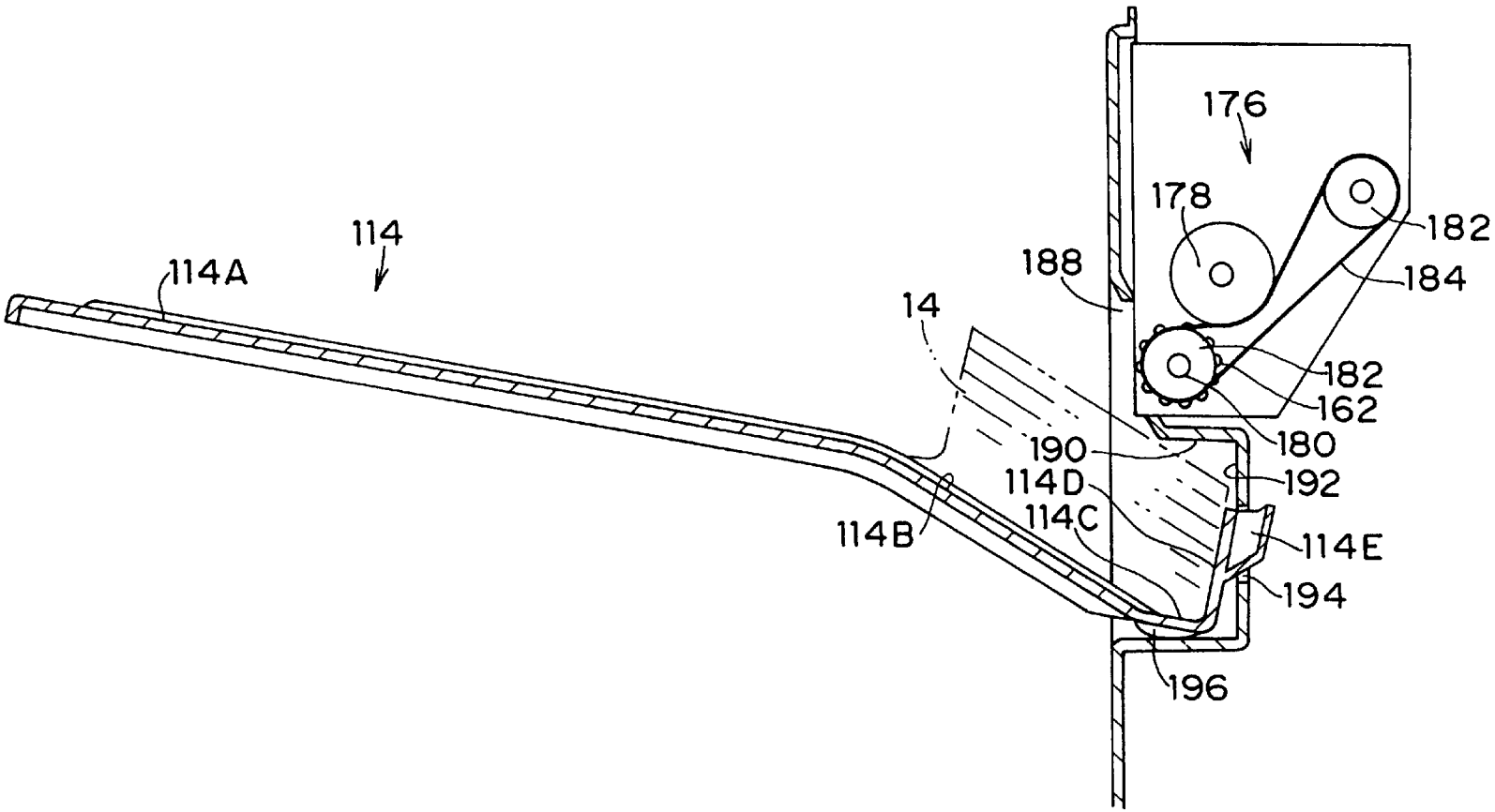
FIG. 21 is a cross-sectional view that illustrates a state in which a short size printing paper is accommodated from the distinct conveying path side onto the accumulation tray in the sorting section of the printer processor having the sheet conveying apparatus according to the present invention.

In the printer processor shown in FIG. 1, a guiding device 176 and an accumulating tray 114 are disposed in order to convey the printing paper 14, having various sizes which are fed in substantially vertical direction from the outlet 44 of the distinct conveying path in the sorting section 36, along the conveying path which is provided in a curved shape so as to turn in the substantially horizontal direction and feed up to the accumulating tray 114 and accumulate as is shown in FIGS. 19 to 21.

This guiding device 176 is mainly comprised of a guiding roller 178 and a guiding belt entraining mechanism. This guiding roller 178 is formed as a large diameter roller capable of forming a circular arc curve that is needed to turn the printing paper 14. Further, the guiding belt entraining mechanism is structured by entraining a guiding belt 184, as an extendable and/or contractible small ring shaped endless belt, around two rollers 180 and 182. The intermediate portion of the guiding belt 184 between the two rollers 180 and 182 is entrained so as to resiliently press-contact with a circular arcuate portion extending over the central angle of about 90° of the guiding roller 178.

Further, it is structured such that any one of the guiding roller 178 or the rollers 180 and 182 is driven by a driving source such as a motor not shown so as to carry out a conveying operation.

Like a conveying path 186 which is shown by a double dotted line in FIG. 19, the guiding belt entraining mechanism thus structured nips the printing paper 14, which is fed downwardly from the substantially vertically upward, resiliently between the guiding roller 178 and the guiding belt 184. The printing paper 14 is conveyed such that the conveying direction thereof is changed by about 90° from the substantially vertical direction to the horizontal direction along the curve of the outer circumferential surface of the guiding roller 178, and then discharged from the outlet 188 onto the accumulation tray 114.

In the above-described guiding belt entraining mechanism, the guiding belt 184 is formed by a singular belt. Instead of this, it can be formed by a plurality of belts as well. Further, it is needless to say that the guiding belt 184 can be entrained around three rollers or more.

The outlet 188 side rollers 182 of the guiding belt entraining mechanism can be provided with printing paper clean-up means which are formed by the above-described clean-up rollers 162, or the like, as are shown in FIGS. 16 and 17.

In the guiding belt entraining mechanism that has been structured as described above, distances among the shafts of the guiding rollers 178 and of the rollers 180 and 182 are slightly different as compared to a structure in which the distance between the shafts of the pair of the rollers for nipping the printing paper 14 therebetween is set with a high accuracy, the difference can be off-set by expanding and/or contracting the guiding belt 184. Accordingly, it becomes easy to assemble and manufacture the guiding belt entraining mechanism without increasing its assembling accuracy and it becomes unnecessary to use expensive components with high accuracy. The number of roller components can be reduced as compared to a case in which a winding conveying path is formed by arranging a large number of rollers. Accordingly, it is not necessary to use guide members for the winding conveying path so that a cheap product capable of being assembled and manufactured inexpensive can be provided. Further, in the case of the printing paper 14 which has been just dried and is thereby liable to be damaged, it is held by being nipped by the large diameter guiding roller 178 and the soft and resiliently deformable guiding belt 184, the printing paper 14 is not damaged.

A tray attachment portion 190 is formed just beneath an outlet 188 of a guiding device 176 that has been structured as described above. The accumulation tray 114 is attached to this tray attachment portion 190 so as to be detachable. This tray attachment portion 190 is formed in a concave configuration whose cross section is formed in a substantially U shape. An opening 194 for engaging the tray is formed at a wall surface 192 of this tray attachment portion 190.

A down-slope portion 114B is formed integrally with the accumulation tray 114 so as to bend continuously from a flat plate shaped flat surface portion 114A at the leading edge side of the accumulation tray 114 to the base end portion side thereof. A supporting plate portion 114C is formed at this down-slope portion 114B in a bending manner. An end plate portion 114D raises from the base end of this supporting plate portion 114C. The supporting plate portion 114C and the end plate portion 114D are formed integrally with each other. An engaging portion 114E, being engaged with the opening 194, is formed integrally with the end plate portion 114D of the accumulation tray 114.

As is shown in FIG. 19, a supporting table portion 196 for holding the accumulation tray 114 together with the engaging portion 114D while abutting a portion of the bottom wall of a tray attachment portion 190 is disposed so as to protrude from the bottom surface portion of this supporting plate portion 114C. Namely, the accumulation tray 114 is mounted in a state shown in FIG. 19 in which the supporting table portion 196 rides on the tray attachment portion 190, the engaging portion 114E enters into the opening 194 and receives a moment in a direction in which the free end portion of the accumulation tray 114 lowers downward.

In this way, the accumulation tray 114 in a state of being mounted as is shown in FIG. 19 is structured such that the flat surface portion 114A thereof inclines gradually so as to extend from the leading edge to the base end side, and the down-slope portion 114B thereof inclines steeply from the leading edge to the base end side, and the supporting plate portion 114C inclines comparatively gradually toward the base end. Further, the end plate portion 114C raises upright from the supporting plate portion 114C.

In the accumulation tray 114 which is used in a state of being mounted as is shown in FIG. 19, when the printing paper 14 is discharged within the range of about 100 mm or less from the outlet 188 of the guiding device 176 in the direction in which the printing paper 14 is discharged, an angle of the down-slope portion 114B of the accumulation tray 114 with respect to this printing paper 14 is formed so as to be 60° or less.

When the printing paper 14 is discharged within the range of about 100 mm or more from the outlet 188 of the guiding device 176 toward the direction in which the printing paper 14 is discharged, the angle of the flat surface portion 114A of the accumulation tray 114 with respect to this printing paper 14 is formed to be 10° or more.

A tray attachment portion 190, to which the above-described accumulation tray 114 is attached, is formed so as to be spaced apart from the guiding device 176 in such a manner that the tray attachment portion 190 and the guiding device 176 do not interfere with each other when about 50 sheets of the printing paper 14 are accommodated between the down-slope portion 114B and the supporting plate portion 114C, of the accumulation tray 114.

In the accumulation tray 114 which has been structured as described above, if the printing paper 14 to be accommodated on this tray are long in the conveying direction thereof, the printing paper 14 which have been discharged from the outlet 188, are placed at the leading edge side of the accumulation tray 114, arranged at an end plate portion 114D side so as to slide toward the base end side of the tray 114 by its own weight, and then accommodated on the accumulation tray 114 steadily as is shown in FIG. 20.

If the printing paper 14 to be accommodated are short in the conveying direction, when the weight thereof is light, they are arranged so as to slide along the down-slope portion 114B that inclines steeply, and steadily accommodated on the accumulation tray 114 as shown in FIG. 21.

Because this accumulation tray 114 is structured so as to be detachable, it is convenient that a maintenance work can be carried out by detaching this accumulation tray 114.

In addition, when a large number of pieces of the printing paper 14 are accommodated on the accumulation tray 114, and the leading edge side of the accumulation tray 114 declines so as to be lowered slightly by the weight of the accommodated printing paper 14, the leading edge portion of this accumulation tray 114 is mounted originally in a state of raising upward during the use. As a result, the pieces of printing paper 14 can be prevented from falling from the leading edge side of the accumulation tray 114.

What is claimed is:

1. A sheet conveying apparatus, comprising:

a conveying path section that feeds a plurality of sheets along a plurality of conveying paths set in a plurality of rows in a state in which the leading edges of the respective sheets in the conveying direction are spaced apart from each other in a longitudinal direction;

high-speed feeding means that is disposed at an outlet portion of said conveying path section, and feeds each of said sheets which have been conveyed along said conveying path at a speed which is higher than or equal to the conveying speed of said conveying path; and a feeding section in which said sheets which have been fed from said high-speed feeding means are arranged by being received by a moving endless belt, and fed out.

2. A sheet conveying apparatus according to claim 1, wherein when the length in the conveying direction of each of said sheets that are conveyed along said conveying path is greater than or equal to a predetermined length, the speed at which said sheets are fed by said high-speed feeding means is reduced to approximately the same speed as said conveying path.

3. A sheet conveying apparatus according to claim 1, wherein the direction in which said sheets are fed from said high-speed feeding means and the direction in which said endless belt moves are orthogonal to each other.

4. A sheet conveying apparatus according to claim 1, wherein teeth grooves are formed at an inner peripheral surface portion of said endless belt.

5. A sheet conveying apparatus according to claim 1, wherein said sheet conveying apparatus is used in a printer processor.

6. A sheet conveying apparatus according to claim 1, wherein a portion of said conveying path section is independently removable to the outside of the apparatus using a slide support mechanism so as to be disposed parallel to said slide support mechanism, wherein said sheet conveying apparatus is provided with an auxiliary supporting structure which receives the independently removable portion of said conveying path section in an auxiliary manner when said slide support mechanism is being removed from or replaced in the apparatus.

7. A sheet conveying apparatus according to claim 6, wherein the side plate portion of the removable portion of said conveying section nearest the front in the direction in which the conveying section is removed and the handle provided on said side plate portion are formed by a resin material whose coefficient of thermal expansion is near that of the metal frame of said conveying path section.

8. A sheet conveying apparatus according to claim 1, wherein the frictional coefficient of said endless belt is greater than or equal to 0.7.

9. A sheet conveying apparatus according to claim 8, wherein teeth grooves are formed at an inner peripheral surface portion of said endless belt.

10. A sheet conveying apparatus, comprising:

a conveying path section having a normal conveying path for conveying said sheet from an inlet to an outlet along a plurality of conveying paths set in a plurality rows in a state where the leading edges of the respective sheets in the direction in which the sheets are conveyed are spaced apart from each other in a longitudinal direction, a distinct conveying path for conveying said sheet from said inlet to another outlet, and a conveying path switching section for switching the path along which said sheet is conveyed from between either said normal conveying path and said distinct conveying path;

high-speed feeding means disposed at the outlet portion of said normal conveying path of said conveying path section which feeds each of said sheets which have been conveyed along said normal conveying path at a speed which is greater than or equal to the conveying speed of said normal conveying path; and a feeding section in which said sheets which have been fed from said high-speed feeding means are arranged by being received by a moving endless belt and fed out.

11. A sheet conveying apparatus according to claim 10, wherein said conveying path switching section is made to perform a switching operation by the switching operation, due to the action of a two way self-holding solenoid, of a switching guide member which acts as a guide for altering the conveying path thereby enabling switched state of the switching guiding member to be maintained even if the power supply to said two way self-holding solenoid is interrupted.

12. A sheet conveying apparatus according to claim 10, wherein, when the length in the conveying direction of said sheet that are fed along said conveying path is greater than or equal to a predetermined length, the speed at which said high-speed feeding means feeds said sheet is reduced to approximately the same speed as said conveying path.

13. A sheet conveying apparatus according to claim 10, wherein the direction in which said sheets are fed from said high-speed feeding means and the direction in which said endless belt moves are orthogonal to each other.

14. A sheet conveying apparatus according to claim 10, wherein teeth grooves are formed at an inner peripheral surface of said endless belt.

15. A sheet conveying apparatus according to claim 10, wherein said sheet conveying apparatus is used in a printer processor.

16. A sheet conveying apparatus according to claim 10, wherein a portion of said conveying path section is independently removable to the outside of the apparatus using a slide support mechanism so as to be disposed parallel to said slide support mechanism, wherein said sheet conveying apparatus is provided with an auxiliary supporting structure which receives the independently removable portion of said conveying path section in an auxiliary manner when said slide support mechanism is being removed from or replaced in the apparatus.

17. A sheet conveying apparatus according to claim 16, wherein the side plate portion of the removable portion of said conveying section nearest the front in the direction in which the conveying section is removed and the handle provided on said side plate portion are formed by a resin material whose coefficient of thermal expansion is near that of the metal frame of said conveying path section.

18. A sheet conveying apparatus according to claim 10, wherein the frictional coefficient of said endless belt is greater than or equal to 0.7.

19. A sheet conveying apparatus according to claim 18, wherein teeth grooves are formed at an inner peripheral surface of said endless belt.

* * * * *